US009328491B2

(12) United States Patent
Kitaura et al.

(10) Patent No.: US 9,328,491 B2
(45) Date of Patent: May 3, 2016

(54) WATER SPOUTING DEVICE

(75) Inventors: Hidekazu Kitaura, Kitakyushu (JP); Koji Takeda, Kitakyushu (JP); Tomohiro Kudo, Kitakyushu (JP); Ryohei Yaita, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 1189 days.

(21) Appl. No.: 13/053,953

(22) Filed: Mar. 22, 2011

(65) Prior Publication Data

US 2011/0240767 A1 Oct. 6, 2011

(30) Foreign Application Priority Data

Mar. 31, 2010 (JP) ..... 2010-082653
Mar. 31, 2010 (JP) ..... 2010-083166

(51) Int. Cl.
*E03C 1/08* (2006.01)
*E03C 1/084* (2006.01)

(52) U.S. Cl.
CPC ..... *E03C 1/084* (2013.01)

(58) Field of Classification Search
CPC ..... B05B 1/18; B05B 7/0425; E03C 1/084
USPC ..... 239/428.5, 428, 397, 575, 588, 590.3, 239/600, 410; 137/888, 891, 893, 895
See application file for complete search history.

(56) References Cited

U.S. PATENT DOCUMENTS 3,261,555 A * 7/1966 Hjulian ..... E03C 1/084 239/427
3,471,091 A * 10/1969 Baker ..... A61H 33/027 239/416
4,211,368 A * 7/1980 Legros et al. ..... 239/315
4,211,468 A * 7/1980 Steensma ..... G02B 6/24 385/33
4,313,564 A * 2/1982 Shames ..... E03C 1/084 239/110
2003/0029935 A1* 2/2003 Takeshi ..... E03C 1/084 239/428.5
2005/0001064 A1* 1/2005 Taketomi ..... E03C 1/084 239/461
2010/0065661 A1 3/2010 Grether et al.

FOREIGN PATENT DOCUMENTS

CA 2349607 * 6/2000 ..... E03C 1/084
CN 1578867 A 2/2005

(Continued)

*Primary Examiner* — Len Tran
*Assistant Examiner* — Joel Zhou
(74) *Attorney, Agent, or Firm* — Studebaker & Brackett PC

(57) ABSTRACT

The present invention provides a water spouting device which enables air bubble entrained water with an increased entrainment rate of air bubbles to be discharged at a low flow rate stage even though the user adjusts the flow rate based on the same feeling as that for a conventional water spouting device, the present water spouting device further enabling, at a high flow rate stage, prevention of discharge of air bubble entrained water with such a total amount as makes the user feel that the resultant amount of water significantly exceeds that intended by the user. A spout cap BC serving as the present water spouting device includes a pressure reducing portion 30 serving as an entrainment rate adjusting portion to adjust the entrainment rate of air bubbles entrained in air bubble entrained water in an air bubble entraining portion 703. The pressure reducing portion 30 serving as the entrainment rate adjusting portion increases the entrainment rate until inflow water from an inflow port 101 reaches a predetermined flow rate, and suppresses an increase in entrainment rate when the inflow water from the inflow port 101 exceeds the predetermined flow rate.

18 Claims, 17 Drawing Sheets

(56) References Cited

FOREIGN PATENT DOCUMENTS

| | | | |
|---|---|---|---|
| DE | 102007003296 | B3 | 7/2008 |
| JP | 2002-070098 | A | 3/2002 |
| JP | 2002-079067 | A | 3/2002 |
| JP | 2002-275969 | A | 9/2002 |
| WO | 01/68995 | A1 | 9/2001 |

* cited by examiner

WATER SPOUTING DEVICE

CROSS-REFERENCE TO RELATED APPLICATION

This application claims benefit under 35 U.S.C. sctn. 119 (a) of Japanese Patent Application No. 2010-082653, filed on Mar. 31, 2010, in the Japan Patent Office, the entire contents of which are incorporated herein by reference

BACKGROUND OF THE INVENTION

1. Field of the Invention

The present invention relates to a water spouting device that can discharge air bubble entrained water.

2. Description of the Related Art

Water spouting devices have been proposed which entrain air bubbles into spouted water to discharge the resultant air bubble entrained water in order to diminish the sound of the water splashing onto a sink or a lavatory bowl to which the water is to be spouted or to suppress splash-back of the water from the sink or the lavatory bowl. In particular, in recent years, a water spouting device has been proposed which starts to increase the entrainment rate of air bubbles at a low flow rate stage with a low flow velocity in order to improve the feeling of massiveness of water, as described in Japanese Patent Laid-Open No. 2002-275969.

The water spouting device in Japanese Patent Laid-Open No. 2002-275969 includes a bubbly water spouting member installed at the tip of a spout of a water faucet via a joint, the bubbly water spouting member including an air entraining mechanism and a rectification mechanism provided in this order from an upstream side in the middle of a channel extending between an inflow port and the discharge port. The air entrainment mechanism includes a pressure reducing plate, a channel surrounding wall formed downstream of the pressure reducing plate, and a backflow preventing portion formed downstream of the channel surrounding wall. The pressure reducing plate includes a plurality of small holes disposed on the circumference of a circle which is concentric with the discharge port and larger than the discharge port in diameter. The pressure reducing plate is disposed so as to close the channel. Air holes are formed in the channel surrounding wall located downstream of the pressure reducing plate. The backflow preventing portion is disposed downstream of an area in which the air holes are formed. The rectification mechanism includes an inclined portion, a rectification portion, a rectification grid, and a rectification path. The inclined portion includes a channel with a diameter decreasing such that the channel is shaped like a funnel downstream of the backflow preventing portion. The rectification portion includes a channel which is concentric with the discharge port and which extends from a downstream end of the inclined portion toward the discharge port. The rectification grid is a grid-like portion of the channel disposed so as to close the rectification portion. The rectification path is a channel connected to the rectification portion downstream of the rectification grid. Moreover, a throttling portion with a smaller channel cross section than that of the joint is provided upstream of the pressure reducing plate.

The water spouting device described in Japanese Patent Laid-Open No. 2002-275969 is configured as described above. Thus, when cleaning water passes through the small holes in the pressure reducing plate, pressure energy is converted into kinetic energy to increase the flow velocity of jet flows from the small holes. The jet flows are entrained with surrounding air because of the viscosity thereof. Water flows generated with the air entrained therein grow into high-speed water flows with relatively large air bubbles, which then collide against the funnel-like inclined portion. The high-speed water flows having collided against the inclined portion become turbulent. Hence, the relatively large air bubbles contained in the high-speed water flows are broken to convert the high-speed water flows into water flows with fine air bubbles entrained therein. The water flows with the air bubbles entrained therein converge along the inclined portion and are rectified by the rectification grid. The water flows are thus integrated together, and the resultant water flow is discharged from the discharge port.

The water spouting device described in Japanese Patent Laid-Open No. 2002-275969 exerts what is called en ejector effect to generate air bubble entrained water. Thus, at a low flow rate stage, the water spouting device can effectively generate water entrained with fine air bubbles to discharge the resultant air bubble entrained water to a sink or a lavatory bowl from the discharge port.

When air bubble entrained water is generated based on the ejector effect, the generation depends on the effect of entraining air into the water as a result of an increase in the flow velocity of the jet flows from the small holes in the pressure reducing plate. Thus, as the water amount and thus the flow velocity increases, the amount of air entrained in the water in the form of air bubbles tends to increase consistently with the flow velocity. Thus, even when the process shifts to a high flow rate stage with a high flow velocity, water with a high entrainment rate of air bubbles is generated and discharged.

At the low flow rate stage, an increase in the entrainment rate of air bubbles entrained in the water allows the feeling of massiveness of spouted water to be improved and contributes to water saving without failing to meet the basic purpose of diminishing the sound of the water splashing onto the sink or lavatory bowl to which the water is to be spouted or suppressing splash-back of the water from the sink or the lavatory bowl. Thus, the arrangement and shapes of members of the water spouting device are designed so as to increase the entrainment rate of air bubbles at the low flow rate stage as much as possible.

However, in actual use, water needs to be supplied not only at such a low flow rate as described but also at a high flow rate. For example, if a glass or a vase is to be filled with water, the amount of water supplied may need to be increased in order to fill the glass or the vase quickly. In the water spouting device described in Japanese Patent Laid-Open No. 2002-275969, an increased flow rate increases the entrainment rate of air bubbles. Thus, under the effect of an increase in the total amount of water resulting from an increased entrainment rate of air bubbles and exceeding the user's intended increase in water amount, air bubble entrained water is discharged at a high flow rate that exceeds a value corresponding to the user's expected feeling. In particular, as more effort is made to design the arrangement and shapes of the members so as to increase the entrainment rate of air bubbles at the low flow rate stage, the above-described phenomenon appears more notably at the high flow rate stage.

If water is used to wash eating utensils or the hands, provided that spouted water gives the appropriate feeling of massiveness and that the washing capability is unchanged, the use of water spouted at a low flow rate is preferable in terms of both the practical use and water saving, and users are expected to use such water spouted at the low flow rate. However, if a glass or a vase is to be filled with water, the user desires to fill the glass or the vase quickly, and thus naturally operates the water spouting device so that the water flows at a high flow rate.

As described above, when the user operates the water spouting device in accordance with the user's feeling so that the water flows at a high flow rate, and as a result, air bubble entrained water is discharged which has such a total amount (corresponding to the actual amounts of water and air bubbles) as makes the user feel that the resultant amount of water significantly exceeds that intended by the user, the feeling of massiveness of spouted water is definitely improved but the following adverse effect may be exerted. Even though an attempt is made to fill the glass or the vase with water, the water overflows the glass or the valve because of a return flow resulting from the high intensity of the water flow. As a result, the glass or the vase may be filled only to half of the volume thereof. Moreover, even when the glass or the vase is to be filled to half of the volume thereof, air bubble entrained water which is in actuality increased in amount by the air bubbles is poured into the glass or the vase. Thus, even with the user's recognition that the glass or the vase has been filled to half of the volume thereof, the glass or the vase may have actually been filled only with a smaller amount of water. Furthermore, in cases other than that where the glass or the vase is filled with water, the water spouting device may fail to meet the basic purpose of diminishing the sound of water splashing onto the sink or lavatory bowl to which the water is to be spouted or suppressing splash-back of the water from the sink or the lavatory.

If the user needs to more precisely adjust the amount of spouted water in order to avoid the above-described problems, the corresponding operation is cumbersome and involves the user's delicate feeling. This may significantly degrade the usability. Furthermore, the following method is possible. The user manually adjusts the opening of the air holes depending on an increase in the amount of water spouted; the user increases the entrainment rate of air bubbles at a low flow rate, while suppressing the entrainment rate of air bubbles at a high flow rate. However, this method is also cumbersome and time-consuming for the user and offers very inferior usability in a practical sense.

The present invention has been developed in view of the above-described problems. An object of the present invention is to provide a water spouting device which enables air bubble entrained water with an increased entrainment rate of air bubbles to be discharged at the low flow rate stage even though the user adjusts the flow rate based on the same feeling as that for the conventional water spouting device, the present water spouting device further enabling, at the high flow rate stage, prevention of discharge of air bubble entrained water with such a total amount as makes the user feel that the resultant amount of water significantly exceeds that intended by the user.

SUMMARY OF THE INVENTION

To accomplish this object, the present invention provides a water spouting device enabling air bubble entrained water to be discharged, the water spouting device including a main body portion with a discharge port formed therein and from which water is discharged, an inflow port formed therein and into which the water to be discharged from the discharge port flows from a water supply source, and an internal channel formed therein and extending from the inflow port to the discharge port; an orifice portion configured to inject the inflow water from the inflow port toward a downstream side of the internal channel; an air bubble entraining portion with an opening portion formed therein and through which air is introduced into the internal channel, the air bubble entraining portion entraining the air introduced from the opening portion into the water injected from the orifice portion to generate air bubble entrained water and supplying the air bubble entrained water to the discharge port; and an entrainment rate adjusting portion configured to adjust an entrainment rate of the air bubbles entrained in the air bubble entrained water in the air bubble entraining portion. The entrainment rate adjusting portion increases the entrainment rate until the inflow water from the inflow port reaches a predetermined flow rate. The entrainment rate adjusting portion suppresses an increase in entrainment rate when the inflow water from the inflow port exceeds the predetermined flow rate.

In the water spouting device according to the present invention, the air bubble entraining portion entrains the air introduced from the opening portion into the water injected from the orifice portion to generate air bubble entrained water and then discharges the air bubble entrained water from the discharge port. Thus, the water spouting device can utilize the ejector effect to easily generate air bubble entrained water. The entrainment rate adjusting portion increases the entrainment rate of the air bubbles entrained in the air bubble entrained water until the inflow water from the inflow port reaches the predetermined flow rate. Thus, air bubble entrained water with a high entrainment rate of air bubbles can be supplied at a low flow rate stage. Hence, spouted water can be provided which offers a feeling of massiveness even at the low flow rate stage. The spouted water allows eating utensils or the hands to be washed in a smaller amount of water than spouted water entrained with no air bubbles. This contributes to water saving and allows splash-back of water to be suppressed.

The entrainment rate adjusting portion suppresses an increase in the entrainment rate of air bubbles entrained in the air bubble entrained water when the inflow water from the inflow port exceeds the predetermined flow rate. Thus, the entrainment rate of air bubbles can be maintained or reduced depending on the amount of the inflow water from the inflow port. Hence, even with the entrainment rate of air bubbles set to be increased to the maximum value at the low flow rate stage, the entrainment rate of air bubbles is prevented from subsequently increasing consistently with the flow rate. As a result, the optimum entrainment rate can be achieved in an area in which the water exceeds the predetermined flow rate. This allows the following situation to be avoided. The user operates the water spouting device in accordance with the user's feeling so that the water is spouted at a high flow rate. Consequently, air bubble entrained water is discharged which has such a total amount (corresponding to the actual amounts of water and air bubbles) as makes the user feel that the resultant amount of water significantly exceeds that intended by the user.

Specifically, the following situation can be avoided. When a glass or a vase is to be filled with water, the water overflows the glass or the vase because of a return flow resulting from the high intensity of the water flow (the return flow occurs when the total amount of water spouted is more than required). As a result, the glass or the vase can be filled only to half of the volume thereof. Moreover, when the glass or the vase is to be filled to about half of the volume thereof, an increase in the amount of water resulting entrainment of the air bubbles can be suppressed. Hence, the glass or the vase can be filled with an exact required amount of water. Furthermore, the amount of unwanted air bubbles can be excluded from the total amount of water spouted at the high flow rate stage. This enables a reduction in the difference in the total amount of spouted water between the low flow rate stage and the high flow rate stage. Therefore, a sharp increase or decrease in the flow velocity of spouted water flow can be suppressed. Additionally, a significant variation in the intensity of the spouted water can be restrained. Hence, a variation in the trajectory of the spouted water can be suppressed which is associated with oblique water spouting or the like. This allows water to be easily spouted exactly to a target position.

As described above, according to the present invention, spouted water with the optimum entrainment rate of air bubbles can be provided both at the low flow rate stage and at the high flow rate stage, without the need for the user to more precisely adjust the amount of water spouted or to manually adjust the amount of air introduced. Thus, a water spouting device can be provided which enables air bubble entrained water with an increased entrainment rate of air bubbles to be discharged at the low flow rate stage even though the user adjusts the flow rate based on the same feeling as that for the conventional water spouting device. The water spouting device further enables, at the high flow rate stage, prevention of discharge of air bubble entrained water with such a total amount as makes the user feel that the resultant amount of water significantly exceeds that intended by the user.

Furthermore, in the water spouting device according to the present invention, the entrainment rate adjusting portion preferably suppresses the amount of the air introduced into the air bubble entraining portion to restrain an increase in the entrainment rate when the inflow water from the inflow port exceeds the predetermined flow rate.

In this preferred aspect, the amount of the air introduced into the air bubble entraining portion is suppressed to restrain an increase in entrainment rate. Thus, an increase in entrainment rate can be reliably restrained by suppressing the amount, proper, of the air introduced into the air bubble entraining portion.

Furthermore, in the water spouting device according to the present embodiment, the entrainment rate adjusting portion preferably increases the entrainment rate until the inflow water from the inflow port reaches the predetermined flow rate and suppresses the flow of the air and thus an increase in entrainment rate so as to hinder the air from being entrained into the air bubble entraining portion when the inflow water from the inflow port exceeds the predetermined flow rate.

In this preferred aspect, in order to suppress an increase in the entrainment rate of air bubbles, the flow of air is restrained so as to hinder the air from being introduced into the air bubble entraining portion. Thus, the flow of the air is suppressed by adjusting the easiness with which the air enters the air bubble entraining portion. Hence, an increase in entrainment rate is suppressed using the simple configuration without the need for advanced means such as adjustment of the amount of water supplied to the air bubble entraining portion or of a force to carry the air to the air bubble entraining portion.

Furthermore, in the water spouting device according to the present invention, the entrainment rate adjusting portion preferably increases a channel resistance in the opening portion to suppress the flow of the air and thus an increase in entrainment rate when the inflow water from the inflow port exceeds the predetermined flow rate.

In this preferred aspect, the flow of the air and thus an increase in entrainment rate are suppressed using the simple configuration for increasing the channel resistance in the opening portion. Thus, the entrainment rate of air bubbles can be adjusted using the simple configuration.

Furthermore, in the water spouting device according to the present invention, the entrainment rate adjusting portion preferably reduces an opening area of the opening portion with respect to the internal channel to suppress the flow of the air and thus an increase in entrainment rate.

In this preferred aspect, the opening area of the opening portion with respect to the internal channel is reduced to increase the channel resistance in the opening portion and thus a loss of pressure of the air passing through the opening portion. Thus, the entrainment rate of air bubbles can be adjusted using the simple configuration.

Furthermore, preferably, the water spouting device according to the present invention includes an attenuation portion configured to attenuate a variation in pressure of the inflow water from the inflow port and then to allow the resultant inflow water to flow out to the downstream side of the internal channel. The entrainment rate adjusting portion includes a pressure receiving plate configured to receive, in an area of the pressure receiving plate including a center thereof, water flowing out from the attenuation portion and is configured to advance and retract freely along the internal channel under a force exerted by the water received by the pressure receiving plate. When the amount of the water received by the pressure receiving plate exceeds a threshold water amount, the entrainment rate adjusting portion moves so as to reduce the opening area.

In this preferred aspect, the entrainment rate adjusting portion includes the pressure receiving plate configured to receive, in the area of the pressure receiving plate including the center thereof, the water flowing out from the attenuation portion and is configured to advance and retract freely along the internal channel under the force exerted by the water received by the pressure receiving plate. Thus, even if the pressure of the inflow water from the inflow port varies, the varying pressure is received by the area of the pressure receiving plate including the center thereof. As a result, the entrainment rate adjusting portion can move stably along the internal channel without being tilted. When the amount of the water received by the pressure receiving plate exceeds the threshold water amount, the entrainment rate adjusting portion moves so as to reduce the opening area. Hence, the entrainment rate of air bubbles can be adjusted using the simple and stable configuration.

Furthermore, in the water spouting device according to the present invention, the entrainment rate adjusting portion preferably increases an internal pressure in the air bubble entraining portion to reduce a difference in pressure between the air on an upstream side of the opening portion and the air in the air bubble entraining portion to suppress an increase in entrainment rate.

In this preferred aspect, the internal pressure in the air bubble entraining portion is increased to reduce the difference in pressure between the air on the upstream side of the opening portion and the air in the air bubble entraining portion. Thus, the entrainment rate of air bubbles can be adjusted using the simple configuration.

Furthermore, the water spouting device according to the present invention includes a rectification portion provided between the air bubble entraining portion and the discharge port to converge and rectify air bubble entrained water generated by the air bubble entraining portion. The entrainment rate adjusting portion preferably increases a channel resistance in the rectification portion and thus an internal pressure in the air bubble entraining portion to suppress an increase in entrainment rate.

In this preferred aspect, the rectification portion is provided between the air bubble entraining portion and the discharge port to converge and rectify the air bubble entrained water generated by the air bubble entraining portion. Thus, bubbly water can be spouted in a neat and clean manner. Furthermore, the channel resistance in the rectification portion is increased to increase the internal pressure in the air bubble entraining portion. Hence, the entrainment rate of air bubbles can be adjusted using the simple configuration without the need to install a separate device for increasing the channel resistance.

In the water spouting device according to the present invention, preferably, the entrainment rate adjusting portion includes an attenuation portion configured to attenuate a variation in pressure of the inflow water from the inflow port and then to allow the resultant inflow water from the inflow port to flow out to the downstream side of the internal channel. The entrainment rate adjusting portion includes a pressure receiving plate configured to receive, in an area of the pressure receiving plate including a center thereof, water flowing out from the attenuation portion and is configured to advance and retract freely along the internal channel under a force exerted by the water received by the pressure receiving plate. When the amount of the water received by the pressure receiving plate exceeds a threshold water amount, the entrainment rate adjusting portion moves so as to reduce a cross-sectional area of the internal channel in the rectification portion.

In this preferred aspect, the entrainment rate adjusting portion includes the pressure receiving plate configured to receive, in the area of the pressure reducing plate including the center thereof, the water flowing out from the attenuation portion and is configured to advance and retract freely along the internal channel under the force exerted by the water received by the pressure receiving plate. Thus, even if the pressure of the inflow water from the inflow port varies, the varying pressure is received by the area of the pressure receiving plate including the center thereof. As a result, the entrainment rate adjusting portion can move stably along the internal channel without being tilted. When the amount of the water received by the pressure receiving plate exceeds the threshold water amount, the entrainment rate adjusting portion moves so as to reduce the cross-sectional area of the internal channel in the rectification portion. Hence, the entrainment rate of air bubbles can be adjusted using the simple and stable configuration.

Furthermore, in the water spouting device according to the present invention, the entrainment rate adjusting portion preferably restrains a force to draw air from the opening portion into the air bubble entraining portion to suppress the amount of introduced air when the inflow water from the inflow port exceeds the predetermined flow rate.

In this preferred aspect, the force to draw air from the opening portion into the air bubble entraining portion is restrained to suppress the amount of the air introduced into the air bubble entraining portion. This eliminates the need to install a separate device such as a pump which can vary a force to forcibly feed in air. Hence, an increase in entrainment rate can be reliably suppressed using the simpler configuration.

Furthermore, preferably, the water spouting device according to the present invention includes a pressure reducing plate provided so as to block the internal channel and including a plurality of holes forming the orifice portion. The air bubble entraining portion is configured to generate a negative pressure by means of water injected from the plurality of holes to draw in air through the opening portion under an effect of the negative pressure. The entrainment rate adjusting portion suppresses an increase in flow velocity of water injected from the plurality of holes to restrain the force to draw in air through the opening portion when the inflow water from the inflow port exceeds the predetermined flow rate.

In this preferred aspect, the pressure reducing plate with the plurality of holes formed therein and forming the orifice portion is provided so as to block the internal channel. Thus, the inflow water from the inflow port can be reliably passed though the plurality of holes. The air bubble entraining portion is configured to generate a negative pressure by means of the water injected from the plurality of holes to draw in air through the opening portion under the effect of the negative pressure. Thus, air bubble entrained water can be generated using the simple configuration without the need to install a separate device for feeding in air. Moreover, when the inflow water from the inflow port exceeds the predetermined flow rate, an increase in the flow velocity of water injected from the plurality of holes is suppressed to restrain the force to draw in air through the opening portion. Hence, the single operation of suppressing an increase in the flow velocity of water injected from the plurality of holes additionally enables the amount of introduced air to be suppressed.

Furthermore, in the water spouting device according to the present invention, the entrainment rate adjusting portion preferably increases the opening area of the plurality of holes to suppress an increase in the flow velocity of the water injected from the plurality of holes when the inflow water from the inflow port exceeds the predetermined flow rate.

In this preferred aspect, when the inflow water from the inflow port exceeds the predetermined flow rate, the opening area of the plurality of holes is increased to suppress an increase in the flow velocity of the water injected from the plurality of holes. Thus, an increase in the flow velocity of the water injected from the plurality of holes can be easily suppressed using the simple configuration for increasing the total area of the plurality of holes as a whole.

Furthermore, in the water spouting device according to the present invention, the entrainment rate adjusting portion preferably includes a path other than the plurality of holes formed downstream of the pressure reducing plate in such a manner that the water flows to and through the path, to suppress an increase in the flow velocity of the water injected from the plurality of holes when the inflow water from the inflow port exceeds the predetermined flow rate.

In this preferred aspect, a bypass path unrelated to drawing of air into the air bubble entraining portion is provided so as to bypass the pressure reducing plate; water flows downstream of the pressure reducing plate through the bypass path when the inflow water from the inflow port exceeds the predetermined flow rate. Alternatively, a sub-path related to drawing of air into the air bubble entraining portion is provided in the pressure reducing plate. Thus, the water otherwise flowing through the plurality of holes forming the orifice portion is passed through the path other than the plurality of holes. This allows suppression of an increase in the amount of the water flowing through the plurality of holes, reliably restraining an increase in the flow velocity of the water injected from the plurality of holes.

Furthermore, in the water spouting device according to the present invention, the entrainment rate adjusting portion preferably suppresses efficiency at which the air bubble entraining portion entrains air bubbles into the water to restrain an increase in entrainment rate when the inflow water from the inflow port exceeds the predetermined flow rate.

In this predetermined aspect, when the inflow water from the inflow port exceeds the predetermined flow rate, the efficiency at which the air bubble entraining portion entrains air bubbles into the water is suppressed to restrain an increase in entrainment rate. Thus, the entrainment rate is adjusted simply by regulating the entrainment efficiency, corresponding to the easiness with which water and air are mixed together, without the need to adjust the amount of air drawn in or the amount of water supplied. Hence, an increase in entrainment rate can be more easily suppressed.

In the water spouting device according to the present invention, in the air bubble entraining portion, the water injected from the orifice portion is temporarily stored between the air bubble entraining portion and the discharge port to form a gas-liquid interface. The water injected from the orifice portion gushes into the gas-liquid interface while being entrained with the air introduced from the opening portion, to form air bubble entrained water. The entrainment rate adjusting portion preferably restrains an increase in the flow velocity of the water gushing into the gas-liquid interface to suppress the entrainment efficiency when the inflow water from the inflow port exceeds the predetermined flow rate.

In this preferred aspect, the water injected from the orifice portion gushes into the gas-liquid interface while being entrained with the air. Thus, the water is subjected to entrainment of the air and incorporation thereof resulting from deformation of the gas-liquid interface. Under these effects, air bubble entrained water is generated. When the inflow water from the inflow port exceeds the predetermined flow rate, an increase in the flow velocity of the water gushing into the gas-liquid interface is suppressed to reduce the amount of air entrained, while restraining deformation of the gas-liquid interface. This allows the entrainment efficiency to be suppressed. Hence, the entrainment efficacy can be easily suppressed using the simple configuration for adjusting the flow velocity.

Furthermore, in the water spouting device according to the present invention, the water injected from the orifice portion is temporarily stored between the air bubble entraining portion and the discharge port to form a gas-liquid interface. The water injected from the orifice portion gushes into the gas-liquid interface while being entrained with the air introduced from the opening portion, to form air bubble entrained water. The entrainment rate adjusting portion preferably reduces a total extension length over which an outer circumference of the water flow gushing into the gas-liquid interface contacts the gas-liquid interface, to suppress the entrainment efficiency, when the inflow water from the inflow port exceeds the predetermined flow rate.

In this preferred aspect, the water injected from the orifice portion gushes into the gas-liquid interface while being entrained with the air. Thus, the water is subjected to entrainment of the air and incorporation thereof resulting from deformation of the gas-liquid interface. Under these effects, air bubble entrained water is generated. Hence, utilizing a variation in the amount of incorporated air which is dependent on the length of the outer circumference of the water flow gushing into the gas-liquid interface, this preferred aspect reduces the total extension length over which the outer circumference of the water flow gushing into the gas-liquid interface contacts the gas-liquid interface to suppress the entrainment efficiency when the inflow water from the inflow port exceeds the predetermined flow rate.

The present invention can provide a water spouting device which enables air bubble entrained water with an increased entrainment rate of air bubbles to be discharged at the low flow rate stage even though the user adjusts the flow rate based on the same feeling as that for the conventional water spouting device, the present water spouting device further enabling, at the high flow rate stage, prevention of discharge of air bubble entrained water with such a total amount as makes the user feel that the resultant amount of water significantly exceeds that intended by the user.

DESCRIPTION OF SYMBOLS

Figure 1:
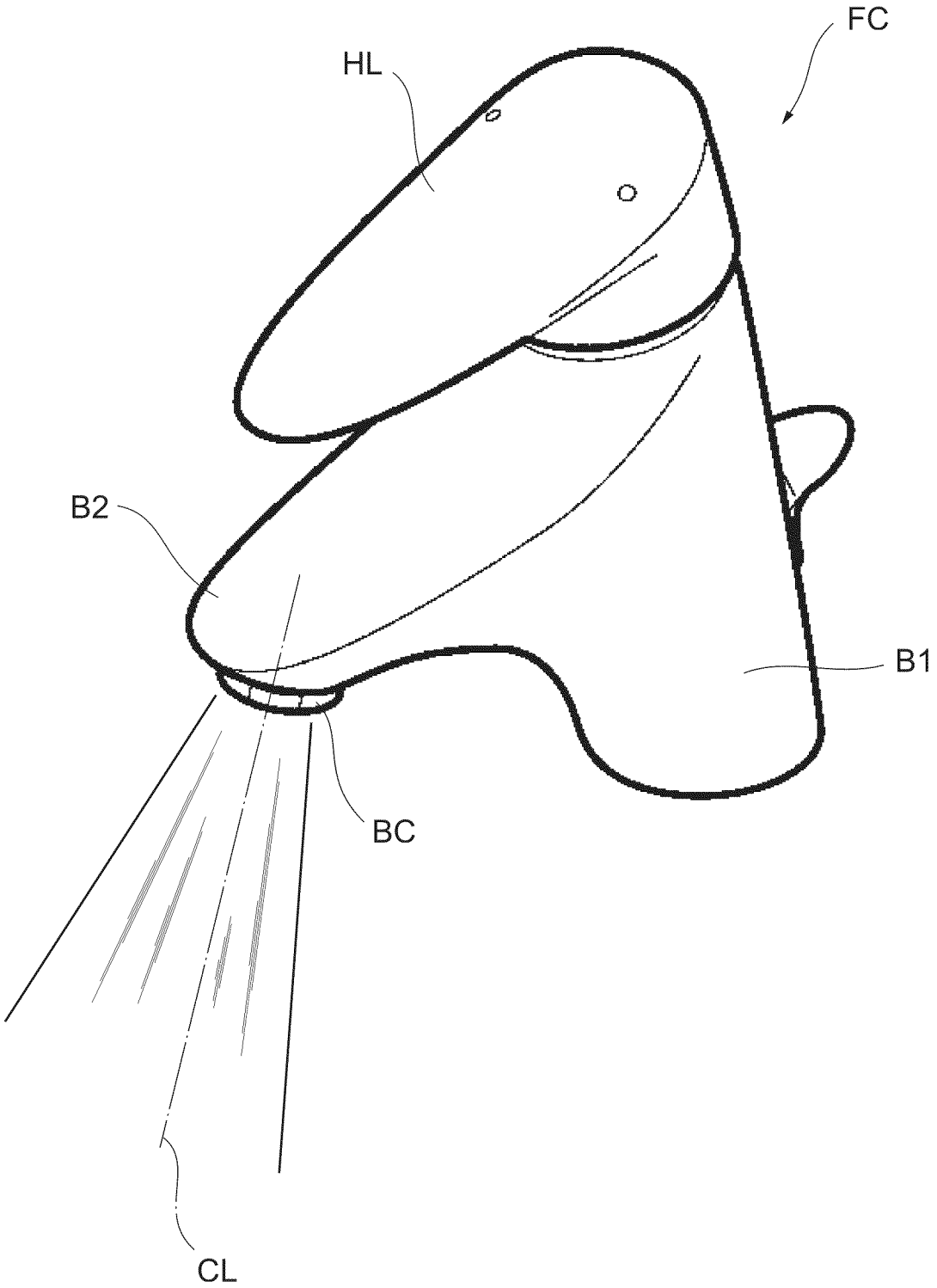
FIG. 1 is a perspective view showing a water faucet device to which a spout cap according to a first embodiment of the present invention is attached.

FC: Water faucet device (water spouting device)
B1: Upright portion
B2: Spout portion
HL: Spout handle
BC: spout cap (water spouting device)
10: First cylindrical portion (main body portion)
20: Second cylindrical portion
30: Pressure reducing portion (entrainment rate adjusting portion and air amount adjusting portion)
40: Upper reduced diameter portion (attenuation portion)
50: Packing
60: Spring
70: Lower reduced diameter portion
80: Rectification portion

101: Inflow port
102: Discharge port
103: Attaching threaded portion
104: Engaging projection
201: First guide portion
202: Outer projection
203: Inner projection
204: Air hole (opening portion)
205: Second guide portion
301: Pressure reducing plate (pressure receiving plate)
302: Upper projection
303: Recess portion
304: Injection hole (orifice portion)
305: Blocking wall (entrainment rate adjusting portion and air amount adjusting portion)
401: Flange portion
402: Annular protruding portion
403: Inflow hole
404: Water storage portion
701: Reduced diameter taper portion
701*a*: Inclined surface
702: Increased diameter taper portion
703: Air bubble entraining portion
801: Rectification grid
802: Air channel
803: Air introduction port

DETAILED DESCRIPTION OF THE PREFERRED EMBODIMENTS

Embodiments of the present invention will be described with reference to the accompanying drawings. To make the description easily understood, the same components are denoted by the same reference numerals in the drawings wherever possible. Duplicate descriptions are omitted.

A spout cap (water spouting device) according to a first embodiment of the present invention will be described with reference to FIG. 1. FIG. 1 is a perspective view showing a water faucet device FC serving as a water spouting device. The water faucet device FC is attached to a wash basin, a hand wash basin, a sink, or the like. The water faucet device FC is configured to spout water to a bowl portion in which the water is stored or which receives the water. The water faucet device FC is attached to the periphery of the bowl portion and connected to a water pipe serving as a water supply source.

The water faucet device FC includes an upright portion B1, a spout portion B2, a spouting handle HL, and a spout cap BC. The upright portion B1 is fixed to an attachment surface by being fixedly attached to the attachment surface so as to extend perpendicularly from the attachment surface or incline forward from the attachment surface.

The spout portion B2, connected to the upright portion B1, is configured to spout water from a spout located at the tip thereof. The spout portion B2 is provided in the vicinity of the upper end of the upright portion B1 so as to project along a generally horizontal direction.

A water faucet handle HL is provided at the upper end of the upright portion B1. By operatively moving the water faucet handle HL up and down, the user can switch between water spouting and water stop and adjust the amount of water spouted. The user can also change the temperature of spouted water by operatively moving the water faucet handle HL right and left.

Figure 2:
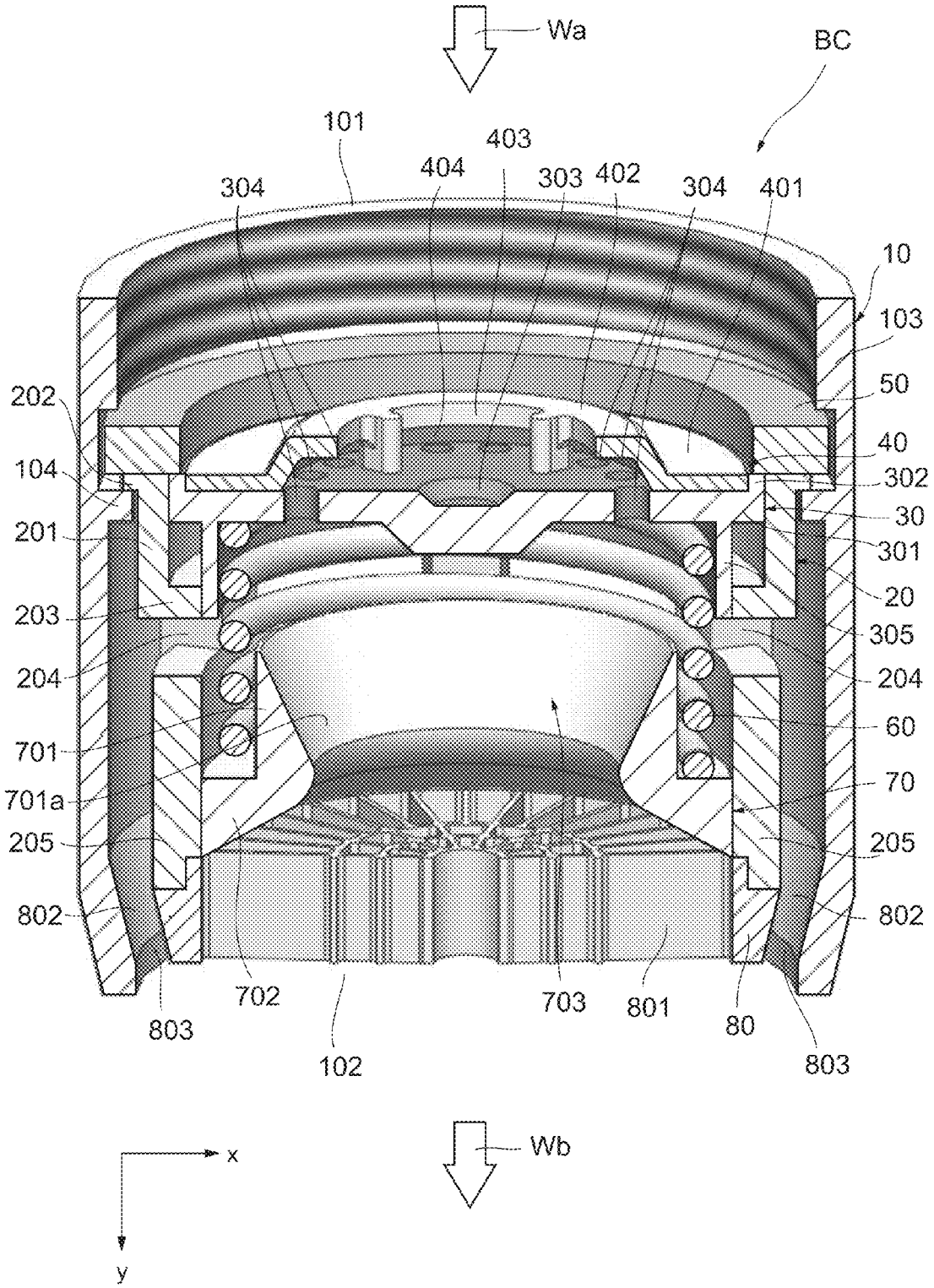
FIG. 2 is a cross-sectional perspective view showing a cross section of the spout cap shown in FIG. 1, the cross section being taken along a center line of the spout cap.

Now, the spout cap BC, attached to the spout of the spout portion B2, will be described with reference to FIG. 2. FIG. 2 is a cross-sectional perspective view showing a cross section of the spout cap BC shown in FIG. 1; the cross section is taken along a center line CL of the spout cap BC. In FIG. 2, a y axis direction is defined as a direction along which the center line CL shown in FIG. 1 extends. An x axis direction is defined as a lateral direction which is orthogonal to the y axis and which extends along the sheet of the drawings.

As shown in FIG. 2, the spout cap BC includes a first cylindrical portion 10 (main body portion), a second cylindrical portion 20, a pressure reducing portion 30 (entrainment rate adjusting portion and air amount adjusting portion), an upper reduced diameter portion 40 (attenuation portion), a packing 50, a spring 60, a lower reduced diameter portion 70, and a rectification portion 80.

The first cylindrical portion 10 is a generally cylindrical member with a cylindrical shape in which the second cylindrical portion 20, the pressure reducing portion 30, the upper reduced diameter portion 40, the packing 50, and the spring 60 are accommodated; the first cylindrical portion 10 functions as the main body portion. An attaching threaded portion 103 is provided on the upper end side, in FIG. 2, of the first cylindrical portion 10 (a terminal side in a negative direction in the y axis direction). The attaching threaded portion 103 is an internal thread allowing the spout cap BC to be attached to the spout of the spout portion B2. The packing 50 is annularly provided under the attaching threaded portion 103 (in a positive direction in the y axis direction) along an inner wall of the first cylindrical portion 10. The packing 50 is a tight contact member for preventing possible water leakage when the spout cap BC is attached to the spout of the spout portion B2.

When the spout cap BC is attached to the spout of the spout portion B2 by threadedly fitting the attaching threaded portion 103 of the first cylindrical portion 10 onto an external thread of the spout of the spout portion B2, water Wa supplied by the water faucet device FC is fed from an inflow port 101. The water Wa flows from the inflow port 101 into the first cylindrical portion 10 serving as the main body portion. The water Wa then passes through the internal channel in the first cylindrical portion 10 (the channel extending through the second cylindrical portion 20, the pressure reducing portion 30, the upper reduced diameter portion 40, the lower reduced diameter portion 70, and the rectification portion 80; the internal channel will be described below in detail) to become water Wb, that is, air bubble entrained water or rectified water (water entrained with substantially no air bubbles). The water Wb is then discharged from a discharge port 102 to the exterior (bowl portion).

The upper reduced diameter portion 40 is arranged downstream of the packing 50 (the upper reduced diameter portion 40 is arranged closer to the discharge port 102 in the positive direction in the y axis direction). The upper reduced diameter portion 40 includes an annular flange portion 401 forming an outer circumference like a flange of a cap and an annular protruding portion 402 surrounded by the flange portion 401 and formed in an area of the upper reduced diameter portion 40 including the center thereof. The flange portion 401 is fixed to the pressure reducing portion 30 in tight contact therewith. As a result, the upper reduced diameter portion 40 and the pressure reducing portion 30 move integrally.

The annular protruding portion 402 is formed so as to project upstream from the flange portion 401 (the annular protruding portion 402 is formed so as to protrude toward the inflow port 101 in the negative direction in the y axis direction). An inflow hole 403 is formed in an area of the annular protruding portion 402 including the center thereof. Inflow water from the inflow port 101 impinges on the upper reduced diameter portion 40, thus allowing a variation in the pressure of the water to be attenuated. The resultant inflow water is then allowed to flow out downstream from the inflow hole 403. The water flowing out downstream from the inflow hole 403 flows into a water storage portion 404 formed between the upper reduced diameter portion 40 and the pressure reducing portion 30.

The pressure reducing portion 30 is arranged downstream of the upper reduced diameter portion 40. The pressure reducing portion 30 includes a pressure reducing plate 301 (pressure receiving plate), an upper projection 302, and a blocking wall 305 (entrainment rate adjusting portion and air amount adjusting portion). The pressure reducing plate 301 is a disk-shaped member. The upper projection 302 is provided close to the outer circumference of the pressure reducing plate 301.

The upper projection 302 is formed to project upstream all over the outer circumference of the pressure reducing plate 301. The flange portion 401 of the upper reduced diameter portion 40 is arranged in abutting contact with an upstream surface of the pressure reducing plate 301 and positioned by the upper projection 302. The annular protruding portion 402 of the upper reduced diameter portion 40 is spaced from the pressure reducing plate 301. Thus, the space between the annular protruding portion 402 and the pressure reducing plate 301 is formed as the water storage portion 404.

A plurality of injection holes 304 (orifice portion) are annularly formed in the pressure reducing plate 301. The plurality of injection holes 304 are formed at positions corresponding to the water storage portion 404. Hence, the plurality of injection holes 304 are formed so as not to be blocked by the flange portion 401 of the upper reduced diameter portion 40.

A recess portion 303 is formed in an area of the pressure reducing plate 301 including the center thereof. The recess portion 303 is formed in the upstream surface of the pressure reducing plate 301. Thus, water flowing out downstream from the inflow hole 403 in the upper reduced diameter portion 40 is converged and centered by the recess portion 303 to act on the pressure reducing plate 301 so as to push down the pressure reducing plate 301 along the y axis direction. The water flowing out downstream from the inflow hole 403 in the upper reduced diameter portion 40 widens toward an outer circumferential direction and is then injected downstream from the plurality of injection holes 304.

The blocking wall 305 is provided on the downstream surface of the pressure reducing plate 301. The blocking wall 305 is provided close to the outer circumference of the pressure reducing plate 301 and projects from the pressure reducing plate 301 so as to span the entire outer circumference thereof. The blocking wall 305 acts to open and close air holes 204 (opening portion) described below in conjunction with up-down movement (advancing and retracting motion along the y axis direction) of the pressure reducing portion 30. When focus is placed on this action, it may be said that the pressure reducing portion 30, particularly the blocking wall 305, functions as an air amount adjusting portion for adjusting the amount of air introduced into the internal channel and as an entrainment rate adjusting portion for adjusting the entrainment rate of the air bubbles entrained in air bubble entrained water.

The second cylindrical portion 20 is provided between the first cylindrical portion 10 and both the upper reduced diameter portion 40 and the pressure reducing portion 30. The second cylindrical portion 20 includes an upstream first guide portion 201 and a downstream second guide portion 205.

An outer projection 202 is provided at the upper end of the first guide portion 201 (the end located closer to the inflow port 101 in the negative direction in the y axis direction) so as to project toward the first cylindrical portion 10. The outer projection 202 is formed to engage with an engaging projection 104 provided inside the first cylindrical portion 10 to place and hold the second cylindrical portion 20 in position with respect to the first cylindrical portion 10.

The pressure reducing plate 301 is arranged inside the first guide portion 201 in abutting contact therewith. The pressure reducing plate 301 of the pressure reducing portion 30 is configured to move up and down along an inner wall surface of the first guide portion 201 (along the y axis direction).

An inner projection 203 is provided at the lower end of the first guide portion 201 (the end located closer to the discharge port 102 in the positive direction in the y axis direction) so as to project toward the internal channel. The inner projection 203 is arranged such that an outer surface of the blocking wall 305 of the pressure reducing portion 30 abuts on the inner projection 203. The blocking wall 305 is configured to move up and down (along the y axis direction) in abutting contact with the inner projection 203.

The air holes 204 (opening portion) configured to introduce air into the internal channel are formed between the first guide portion 201 and the second guide portion 205. The air holes 204 are formed between the first guide portion 201 and the second guide portion 205 so as to be scattered all over the circumference of the second cylindrical portion 20. The air holes 204 are formed immediately below the inner projection 203 of the first guide portion 201. Thus, the air holes 204 are configured to be opened and closed by movement of the blocking wall 305 described above.

A space is formed between the first cylindrical portion 10 and the second cylindrical portion 20 as an air channel 802. The area between a downstream end of the first cylindrical portion 10 and a downstream end of the second cylindrical portion 20 is open and is formed as an air introduction port 803. Air introduced from the air introduction port 803 is introduced from the air holes 204 into the internal channel through the air channel 802.

The lower reduced diameter portion 70 is arranged inside the second guide portion 205. The lower reduced diameter portion 70 is a cylindrical member including a reduced diameter taper portion 701 and an increased diameter taper portion 702. The reduced diameter taper portion 701 is provided upstream of the increased diameter taper portion 702 and formed such that the width of the internal channel decreases from the upstream side to the downstream side. The increased diameter taper portion 702 is provided downstream of the reduced diameter taper portion 701 and formed such that the width of the internal channel increases from the upstream side to the downstream side.

An inclined surface 701*a* of the reduced diameter taper portion 701 which is an inner surface thereof is formed at a position corresponding to the plurality of injection holes 304 in the pressure reducing portion 30. Thus, water injected from the plurality of injection holes 304 in the pressure reducing plate 301 impinges on the inclined surface 701*a* and is thus directed inward.

When water fed from the inflow port 101 is injected from the plurality of injection holes 304 in the pressure reducing plate 301, the water starts to be filled in the spout cap from the downstream side. Then, a gas-liquid interface is formed at a position corresponding to the lower reduced diameter portion 70. The water flow directed by the inclined surface 701*a* gushes into the gas-liquid surface while being entrained with air. Thus, air bubble entrained water is generated. The pressure reducing plate 301 acts to exert a negative pressure between the pressure reducing plate 301 and the lower reduced diameter portion 70. Hence, air is drawn in from the air holes 204 and gushes into the gas-liquid interface together with the water injected from the plurality of injection holes 304. The water flow gushing into the gas-liquid interface disturbs the gas-liquid interface and thus becomes more likely to be entrained with air bubbles. Thus, the area extending from the pressure reducing plate 301 to the lower reduced diameter portion 70 is formed as an air bubble entraining portion 703.

The air bubble entrained water generated by the air bubble entraining portion 703 is rectified by a rectification grid 801 of the rectification portion 80 provided downstream of the second guide portion 205. The rectified air bubble entrained water is then discharged from the discharge port 102 to the exterior.

The spring 60 serving as bias means is arranged between the pressure reducing portion 30 and the lower reduced diameter portion 70. The spring 60 is arranged so as to wind externally around the reduced diameter taper portion 701 of the lower reduced diameter portion 70 and internally around the blocking wall 305 of the pressure reducing portion 30.

Thus, when the water fed from the inflow port 101 flows through the inflow hole 403 in the upper reduced diameter portion 40 and impinges on the pressure reducing plate 301 of the pressure reducing portion 30, the pressure reducing portion 30 is subjected to a force to push down the pressure reducing portion 30 from the upstream side to the downstream side. The spring 60 is arranged to resist this force, and thus movement of the blocking wall 305 can be adjusted as follows. The blocking wall remains stationary until a predetermined flow rate of water is fed from the inflow port 101 (or moves to the degree that the air holes 204 are not blocked) and moves to block the air holes 204 when the flow rate of the water fed from the inflow port 101 exceeds the predetermined value.

Figure 3:
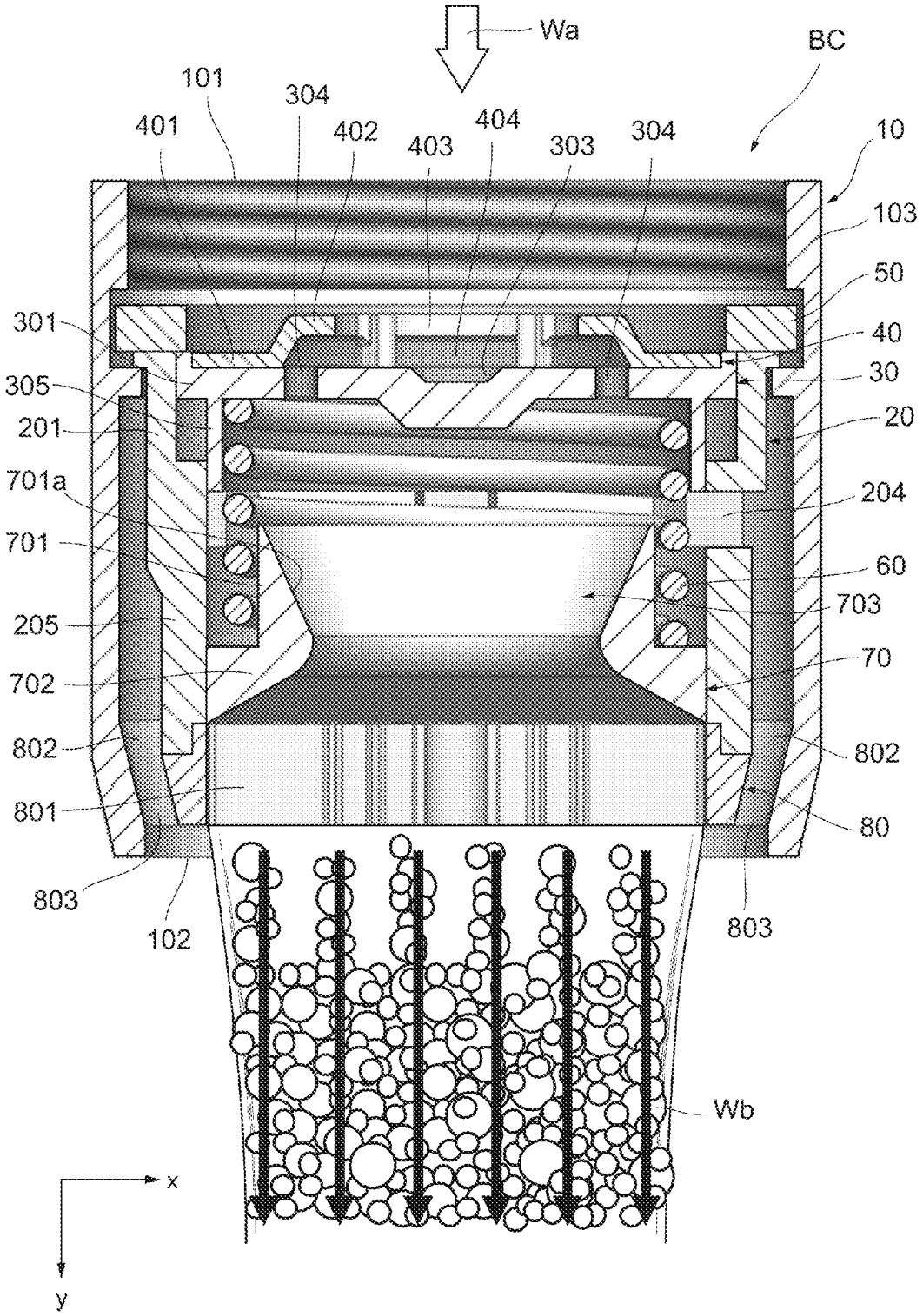
FIG. 3 is a cross-sectional view illustrating the behavior of the spout cap shown in FIG. 2.
Figure 4:
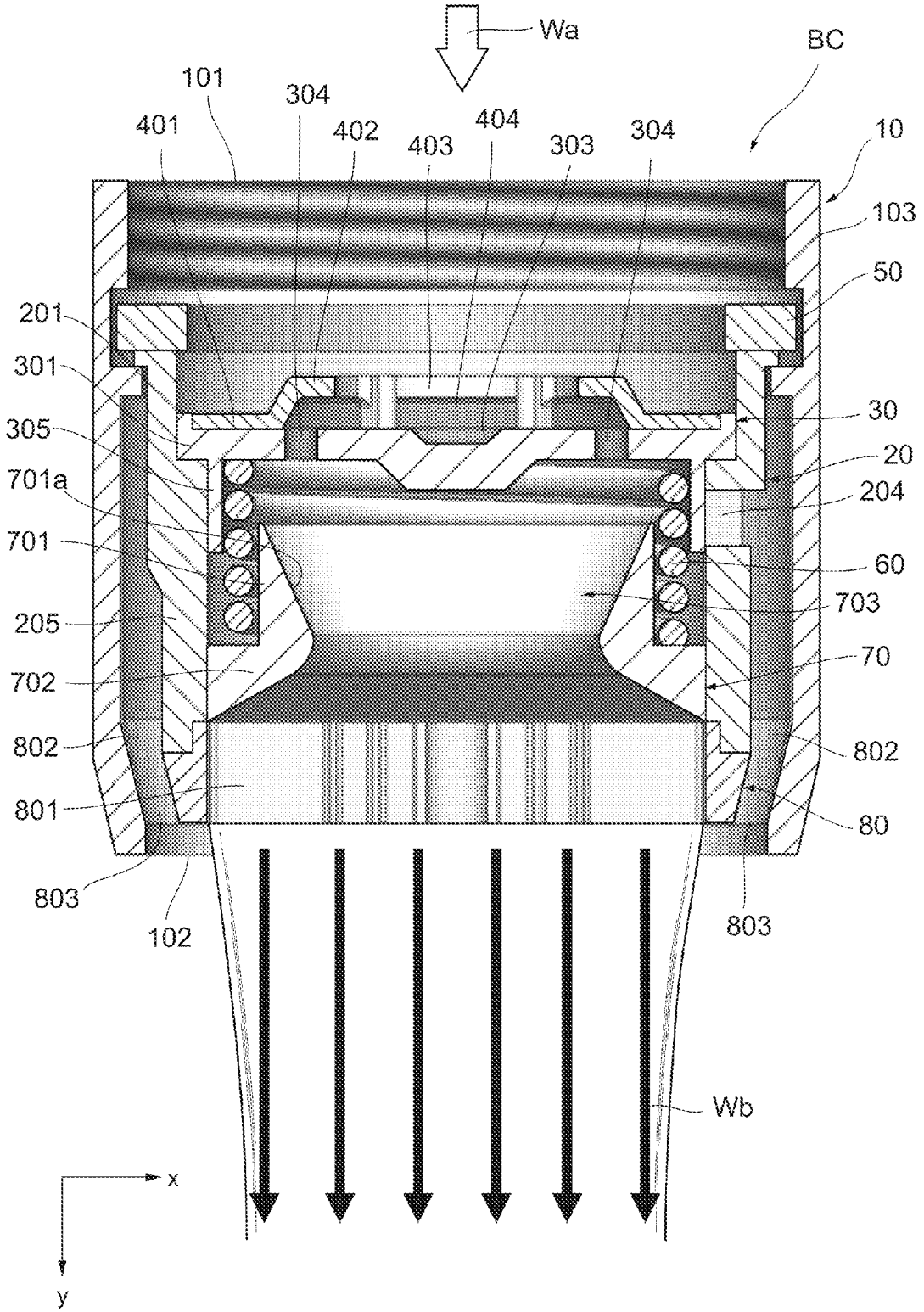
FIG. 4 is a cross-sectional view illustrating the behavior of the spout cap shown in FIG. 2.

Such movement of the blocking wall 305 will be described with reference to FIG. 3 and FIG. 4. FIG. 3 is a cross-sectional view showing how the spout cap BC operates until the inflow water from the inflow port 101 reaches a predetermined flow rate. FIG. 4 is a cross-sectional view showing how the spout cap BC operates when the inflow water from the inflow port 101 exceeds the predetermined flow rate.

As shown in FIG. 3, until the inflow water from the inflow port 101 reaches a predetermined flow rate, the force of the spring 60 to push the pressure reducing plate 301 upstream (the negative direction in the y axis direction) overcomes the force of the inflow water Wa to push the pressure reducing plate 301 (pressure receiving plate) downstream (the positive direction in the y axis direction). Thus, the pressure reducing plate 301 remains at the initial position thereof. Consequently, the blocking wall 305 avoids blocking the air holes 204, allowing air to be continuously fed into air bubble entraining portion 703, which is at a negative pressure.

Hence, the water injected from the plurality of injection holes 304 gushes into the gas-liquid interface formed in the air bubble entraining portion 703, while being entrained with air. The water disturbs the gas-liquid interface and incorporates the air to generate air bubble entrained water. Thus, the water Wb discharged from the discharge port 102 is air bubble entrained water.

On the other hand, as shown in FIG. 4, when the inflow water from the inflow port 101 exceeds the predetermined flow rate, the force of the inflow water Wa to push the pressure reducing plate 301 (pressure receiving plate) downstream (the positive direction in the y axis direction) overcomes the force of the spring 60 to push the pressure reducing plate 301 upstream (the negative direction in the y axis direction). As a result, the pressure reducing plate 301 moves downward from the initial position thereof. Hence, the blocking wall 305 lowers gradually to regulate the feeding of the air into the air bubble entraining portion 703. Then, as shown in FIG. 4, the blocking wall 305 then moves to a position where the blocking wall closes the air holes 204. Thus, the feeding of the air into the air bubble entraining portion 703 is stopped.

Consequently, the water injected from the plurality of injection holes 304 gushes into the gas-liquid interface formed in the air bubble entraining portion 703, without being entrained with air. Hence, no air bubble entrained water is generated. Thus, the water Wb discharged from the discharge port 102 is rectified water with no bubbles entrained therein.

Figure 5:
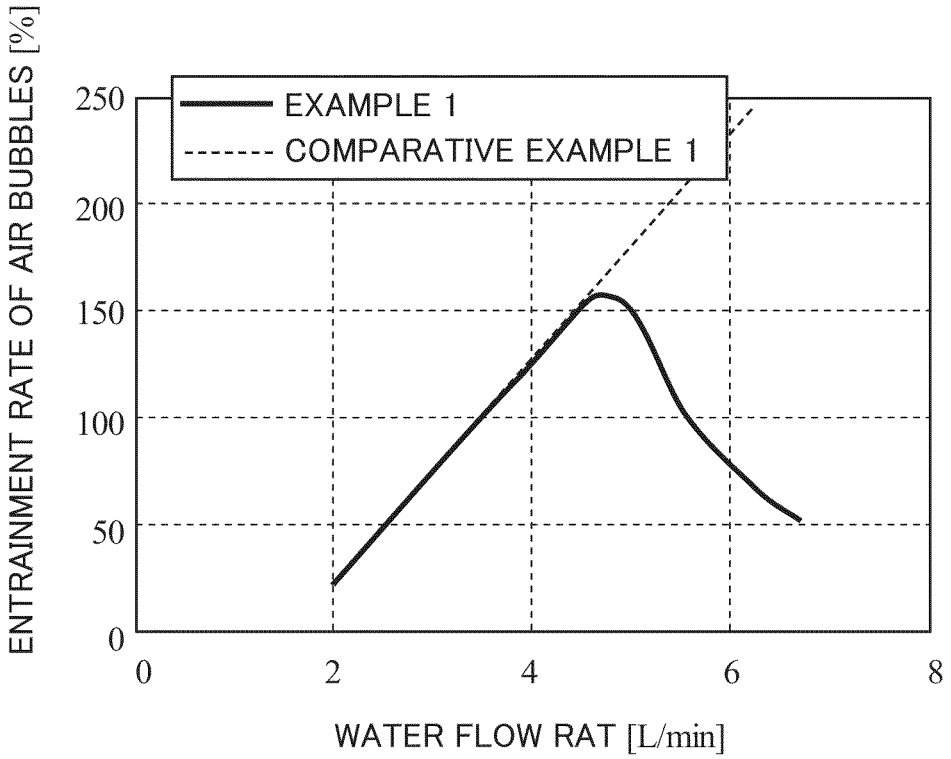
FIG. 5 is a diagram illustrating the relationship between the amount of water and the entrainment rate of air bubbles observed when the spout cap shown in FIG. 1 to FIG. 4 is used.

FIG. 5 illustrates a comparison of the entrainment rate of air bubbles obtained when the above-described spout cap BC is used to progressively increase the flow rate of the water Wa supplied to the inflow port 101 and the entrainment rate of air bubbles obtained when a spout cap with the immobile pressure reducing plate 301 is used. Example 1 in FIG. 5 uses the spout cap BC. Comparative Example 1 in FIG. 5 uses the spout cap BC with the pressure reducing plate 301 fixed so as to be immobile. The entrainment rate of air bubbles according to the present embodiment indicates the ratio of the total volume of the air bobbles in the air bubble entrained water to the volume of the water in the air bubble entrained water. Specifically, the air bubble entrained water is separated into water and air bubbles (air), the volumes of the water and the air bubbles are measured, and the entrainment rate of air bubbles is then calculated.

In Comparative Example 1, the entrainment rate of air bubbles increases in proportion to the flow rate of water supplied. On the other hand, in Example 1, the pressure reducing plate 301 is configured to be immobile until the predetermined flow rate (about 4.2 L/min) is reached. Thus, the entrainment rate of air bubbles increases in proportion to the flow rate of water supplied. However, when the predetermined flow rate (about 4.2 L/min) is exceeded, the pressure reducing plate 301 starts to move downstream, thus gradually suppressing the entrainment rate of air bubbles. When the flow rate is close to about 5 L/min, the blocking wall 305 blocks the air holes 204 to significantly suppress the entrainment rate of air bubbles.

As described above, the spout cap BC (water spouting device) according to the present embodiment enables air bubble entrained water to be discharged. The spout cap BC includes the first cylindrical portion 10 (main body portion) with the discharge port 102 formed therein and from which the water Wb is discharged, the inflow port 101 formed therein and into which the water Wa to be discharged from the discharge port 102 flows from a water supply source, and the internal channel extending from the inflow port 101 to the discharge port 102 is formed; the plurality of injection holes 304 (orifice portion) configured to inject the inflow water from the inflow port 101 toward a downstream side of the internal channel; the air bubble entraining portion 703 with and the air holes 204 (opening portion) formed therein and through which air is introduced into the internal channel, the air bubble entraining portion 703 entraining the air introduced from the air holes 204 into the water injected from the plurality of injection holes 304 to generate air bubble entrained water and supplying the air bubble entrained water to the discharge port 102; and the blocking wall 305 (entrainment rate adjusting portion) configured to adjust the entrainment rate of the air bubbles entrained in the air bubble entrained water in the air bubble entraining portion 703. The blocking wall 305 functioning as the entrainment rate adjusting portion increases the entrainment rate until the inflow water from the inflow port 101 reaches the predetermined flow rate. The blocking wall 305 suppresses an increase in entrainment rate when the inflow water from the inflow port 101 exceeds the predetermined flow rate.

In the spout cap BC serving as the water spouting device according to the present embodiment, the air bubble entraining portion 703 entrains the air introduced from the air holes 204 serving as the opening portion into the water injected from the plurality of injection holes 304 serving as the orifice portion to generate air bubble entrained water and then discharges the air bubble entrained water from the discharge port 102. Thus, the spout cap BC can utilize the ejector effect to easily generate air bubble entrained water. The blocking wall 305 serving as the entrainment rate adjusting portion increases the entrainment rate of the air bubbles entrained in the air bubble entrained water until the inflow water from the inflow port 101 reaches the predetermined flow rate. Thus, air bubble entrained water with a high entrainment rate of air bubbles can be supplied at the low flow rate stage. Hence, spouted water can be provided which offers a feeling of massiveness even at the low flow rate stage. The spouted water allows eating utensils or the hands to be washed in a smaller amount of water than spouted water entrained with no air bubbles. This contributes to water saving and allows splash-back of water to be suppressed.

The blocking wall 305 serving as the entrainment rate adjusting portion suppresses an increase in the entrainment rate of the air bubbles entrained in the air bubble entrained water when the inflow water from the inflow port 101 exceeds the predetermined flow rate. Thus, the entrainment rate of air bubbles can be maintained or reduced depending on the amount of inflow water from the inflow port 101. Hence, even with the entrainment rate of air bubbles set to be increased to the maximum value at the low flow rate stage, the entrainment rate of air bubbles is prevented from subsequently increasing consistently with the flow rate. As a result, the optimum entrainment rate can be achieved in an area in which the water exceeds the predetermined flow rate (see FIG. 5). This allows the following situation to be avoided. The user operates the spout cap in accordance with the user's feeling so that the water is spouted at a high flow rate. Consequently, air bubble entrained water is discharged which has such a total amount (corresponding to the actual amounts of water and air bubbles) as makes the user feel that the resultant amount of water significantly exceeds that intended by the user.

Specifically, the following situation can be avoided. When a glass or a vase is to be filled with water, the water overflows the glass or the vase because of a return flow resulting from the high intensity of the water flow (the return flow occurs when the total amount of water spouted is more than required). As a result, the glass or the vase can be filled only to half of the volume thereof. Moreover, when the glass or the vase is to be filled to about half of the volume thereof, an increase in the amount of water resulting from the entrainment of the air bubbles can be suppressed. Hence, the glass or the vase can be filled with an exact required amount of water. Furthermore, the amount of unwanted air bubbles can be excluded from the total amount of water spouted at the high flow rate stage. This enables a reduction in the difference in the total amount of spouted water between the low flow rate stage and the high flow rate stage. Therefore, a sharp increase or decrease in the flow velocity of spouted water flow can be suppressed. Additionally, a significant variation in the intensity of the spouted water can be restrained. Hence, a variation in the trajectory of the spouted water can be suppressed which is associated with oblique water spouting or the like. This allows water to be spouted exactly to a target position.

As described above, the use of the spout cap BC according to the present embodiment provides spouted water with the optimum entrainment rate of air bubbles both at the low flow rate stage and at the high flow rate stage, without the need for the user to more precisely adjust the amount of water spouted or to manually adjust the amount of the air introduced. Thus, air bubble entrained water with an increased entrainment rate of air bubbles can be discharged at the low flow rate stage even though the user adjusts the flow rate using the water faucet device FC (water spouting device) with the spout cap BC attached thereto based on the same feeling as that for the conventional water faucet device (water spouting device). The spout cap BC further enables, at the high flow rate stage, prevention of discharge of air bubble entrained water with such a total amount as makes the user feel that the resultant amount of water significantly exceeds that intended by the user.

As described above, the pressure reducing portion 30 including the blocking wall 305 according to the present embodiment functions as the entrainment rate adjusting portion for adjusting the entrainment rate of the air bubbles entrained in the air bubble entrained water. More specifically, the flow of air is restrained to suppress an increase in the entrainment rate of air bubbles. Thus, the flow of the air is suppressed by adjusting the easiness with which the air enters the air bubble entraining portion 703. Hence, an increase in entrainment rate is suppressed using the simple configuration without the need for advanced means such as adjustment of the amount of air supplied to the air bubble entraining portion 703 or a force to carry the air to the air bubble entraining portion 703.

Furthermore, the pressure reducing portion 30 functioning as the entrainment rate adjusting portion according to the present embodiment suppresses the amount of the air introduced into the air bubble entraining portion 703 to restrain an increase in entrainment rate when the inflow water from the inflow port 101 exceeds the predetermined flow rate. Thus, since the amount of the air introduced into the air bubble entraining portion 703 is suppressed to restrain an increase in entrainment rate, an increase in entrainment rate can be reliably restrained by suppressing the amount, proper, of the air introduced into the air bubble entraining portion 703.

Additionally, the pressure reducing portion 30 functioning as the entrainment rate adjusting portion according to the present embodiment increases the channel resistance in the air holes 204 functioning as the opening portion to suppress the flow of the air and an increase in entrainment rate when the inflow water from the inflow port 101 exceeds the predetermined flow rate. Thus, the present embodiment utilizes the simple configuration for increasing the channel resistance in the air holes 204 serving as the opening portion to increase a loss of the pressure of the air passing through the air holes 204, thus suppressing the flow of the air and thus an increase in entrainment rate. As a result, the entrainment rate of air bubbles can be adjusted using the simple configuration.

As a technique for increasing a loss of the pressure of the air passing through the air holes 204, the pressure reducing portion 30 functioning as the entrainment rate adjusting portion reduces the opening area of the air holes 204 with respect to the internal channel to suppress the flow of the air and thus an increase in entrainment rate. In other words, the opening area of the air holes 204 with respect to the internal channel is reduced to increase the channel resistance in the air holes 204. Thus, the channel resistance in the air holes 204 is increased to increase a loss of the pressure of the air passing through the air holes 204. Hence, the entrainment rate of air bubbles can be adjusted using the simple configuration.

Furthermore, in the present embodiment, the spout cap includes the upper reduced diameter portion 40 functioning as the attenuation portion for attenuating a variation in the pressure of the inflow water from the inflow port 101 and then allowing the resultant inflow water to flow out to the downstream side of the internal channel. The pressure reducing portion 30 functioning as the entrainment rate adjusting portion includes the pressure reducing plate 301 functioning as the pressure receiving plate that receives, in an area of the pressure reducing plate 301 including the center thereof, the water flowing out from the upper reduced diameter portion 40 functioning as the attenuation portion. The pressure reducing portion 30 is configured to advance and retract freely along the internal channel under the force exerted by the water received by the pressure reducing plate 301. When the amount of the water received by the pressure reducing plate 301 functioning as the pressure receiving plate exceeds a threshold water amount, the pressure reducing portion 30 (blocking wall 305) moves so as to reduce the opening area of the air holes 204.

As described above, the pressure reducing portion 30 includes the pressure reducing plate 301 functioning as the pressure receiving plate that receives, in the area of the pressure reducing plate 301 including the center thereof, the water flowing out from the upper reduced diameter portion 40 functioning as the attenuation portion. The pressure reducing portion 30 is further configured to advance and retract freely along the internal channel under the force exerted by the water received by the pressure reducing plate 301 functioning as the pressure receiving plate. Thus, even if the pressure of the inflow water from the inflow port 101 varies, the varying pressure is received by the area of the pressure reducing plate 301 including the center thereof. As a result, the pressure reducing portion 30 can move stably along the internal channel without being tilted. When the amount of the water received by the pressure reducing plate 301 exceeds the threshold water amount, the pressure reducing portion 30 moves so as to reduce the opening area of the air holes 204. Hence, the entrainment rate of air bubbles can be adjusted using the simple and stable configuration.

Furthermore, from a different viewpoint, the pressure reducing plate 301 functioning as the pressure receiving plate receives the water flowing out from the upper reduced diameter portion 40 functioning as the attenuation portion, and the pressure reducing portion 30 functioning as the air amount adjusting portion advances and retracts freely along the internal channel under the force exerted by the water on the pressure reducing plate 301 functioning as the pressure receiving plate. From this viewpoint, the opening area, with respect to the internal channel, of the air holes 204 functioning as the opening portion is varied by advancement and retraction of the pressure reducing portion 30 (air amount adjusting portion) along the internal channel (which is partly defined by an inner wall of the second cylindrical portion 20). The opening area is maintained until the inflow water from the inflow port 101 reaches the predetermined flow rate, and decreases when the inflow water from the inflow port 101 exceeds the predetermined flow rate.

That is, the spout cap includes the upper reduced diameter portion 40 and the pressure reducing portion 30 (blocking wall 305). The upper reduced diameter portion 40 functions as the attenuation portion for attenuating a variation in the pressure of the inflow water from the inflow port 101 and allowing the resultant inflow water to flow out to the downstream side of the internal channel. The pressure reducing portion 30 includes the pressure reducing plate 301 functioning as the pressure receiving plate that receives the water flowing out from the upper reduced diameter portion 40, and functions as the air amount adjusting portion along the internal channel under the force exerted by the water received by the pressure reducing plate 301. The pressure reducing portion 30 is further configured to advance and retract freely. Thus, even if the pressure of the inflow water from the inflow port 101 varies, the varying pressure is attenuated by the upper reduced diameter portion 40 and then received by the pressure reducing plate 301 functioning as the attenuation portion. As a result, the pressure reducing portion 30 (blocking wall 305) serving as the air amount adjusting portion can move stably along the internal channel without being tilted.

In the present embodiment, the pressure reducing plate 301 functioning as the pressure receiving plate is configured such that the area of the pressure reducing plate 301 including the center thereof receives the water flowing out from the upper reduced diameter portion 40 serving as the attenuation portion. Thus, even if the pressure of the inflow water from the inflow port 101 varies, the pressure reducing plate 301 functioning as the pressure receiving plate can receive the varying pressure in the area of the pressure reducing plate 301 including the center thereof. As a result, since the pressure reducing plate 301 serving as the pressure receiving plate can be allowed to behave more stably, the pressure reducing portion 30 (blocking wall 305) serving as the air amount adjusting portion can move stably along the internal channel without being tilted.

The recess portion 303 is formed in the area of the pressure reducing plate 301 serving as the pressure receiving plate which area includes the center thereof, to receive the water flowing out from the upper reduced diameter portion 40 serving as the attenuation portion. Since the recess portion 303 is thus formed in the area of the pressure reducing plate 301 serving as the pressure receiving plate which area includes the center thereof, the force of the water impinging on the pressure reducing plate 301 and then directed in a lateral direction can be converged and directed downward by the recess portion 303. Hence, the pressure reducing portion 30 (blocking wall 305) serving as the air amount adjusting portion can be allowed to behave more appropriately along the internal channel. This allows the pressure reducing portion 30 (blocking wall 305) to move stably along the internal channel without being tilted.

The water storage portion 404 in which water is temporarily stored is provided between the upper reduced diameter portion 40 serving as the attenuation portion and the pressure reducing plate 301 serving as the pressure receiving plate. Since the water storage portion 404 in which water is temporarily stored is thus provided between the upper reduced diameter portion 40 serving as the attenuation portion and the pressure reducing plate 301 serving as the pressure receiving plate, the water stored in the water storage portion 404 exerts a buffering effect to restrain the pressure reducing plate 301 serving as the pressure receiving plate from being loosened. As a result, the pressure reducing plate 301 can move stably along the internal channel.

Furthermore, the internal channel according to the present embodiment includes a circular cross section portion corresponding at least to a portion of the internal channel in which the air holes 204 are formed and having a generally circular channel cross section. The pressure reducing portion 30 serving as the air amount adjusting portion is formed such that the outer circumference of the pressure reducing plate 301 serving as the pressure receiving plate is generally circular along the circular cross section portion. A plurality of the air holes 204 serving as the opening portion are provided so as to surround the internal channel along the channel cross section thereof.

As described above, in the present embodiment, the pressure reducing portion 30 serving as the air amount adjusting portion moves stably to enable stable variation of the opening area, with respect to the internal channel, of the air holes 204 serving as the opening portion. Since the outer circumference of the pressure reducing plate 301 serving as the pressure receiving plate is formed to be generally circular along the circular cross section portion of the internal channel and a plurality of the air holes 204 serving as the opening portion are provided so as to surround the internal channel along the channel cross section thereof, the opening area of each of the air holes 204, arranged around the internal channel, can be adjusted to a given value. This allows air bubble entrained water to be more stably generated.

Figure 6:
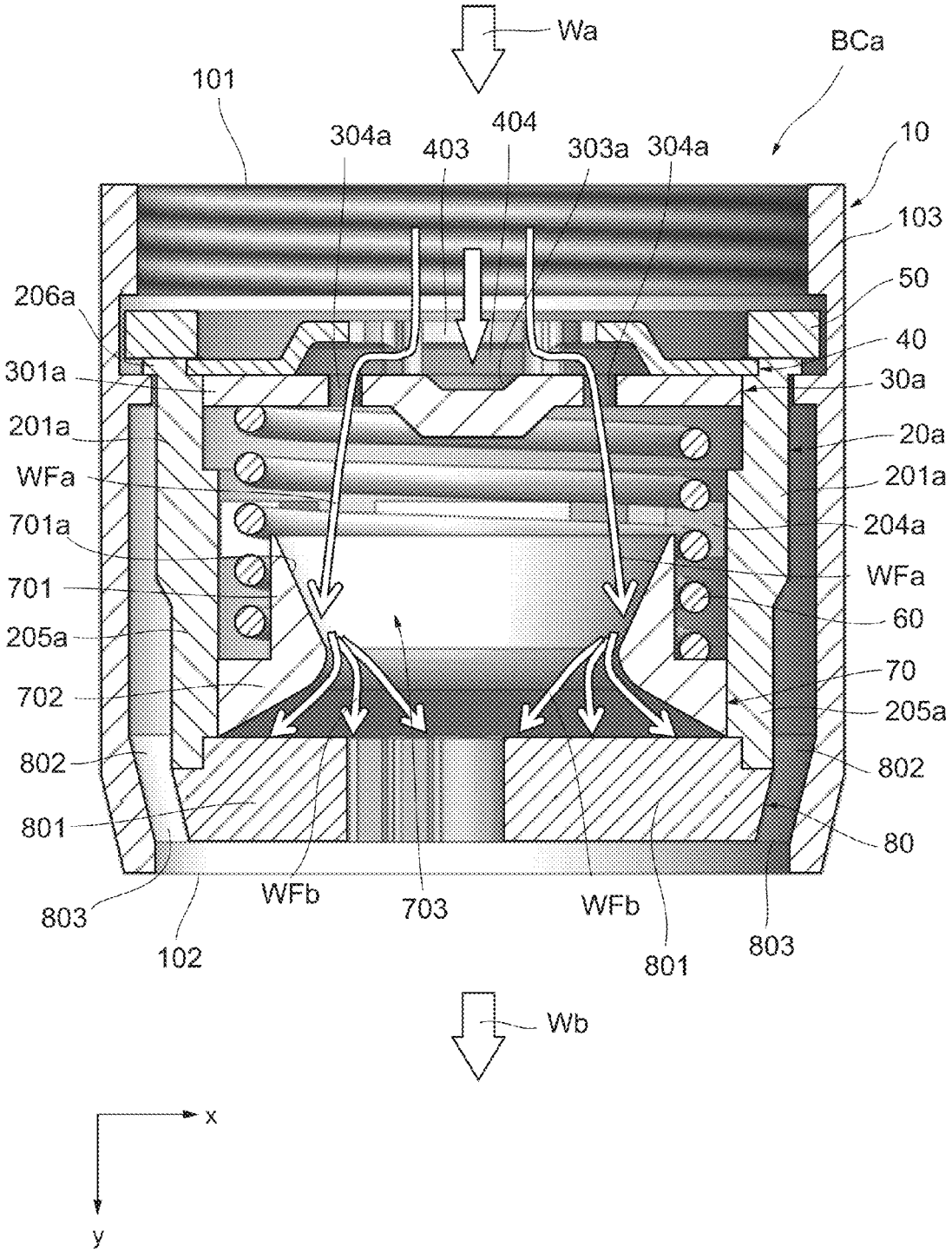
FIG. 6 is a cross-sectional view showing a spout cap according to a first modification of the first embodiment of the present invention.
Figure 7:
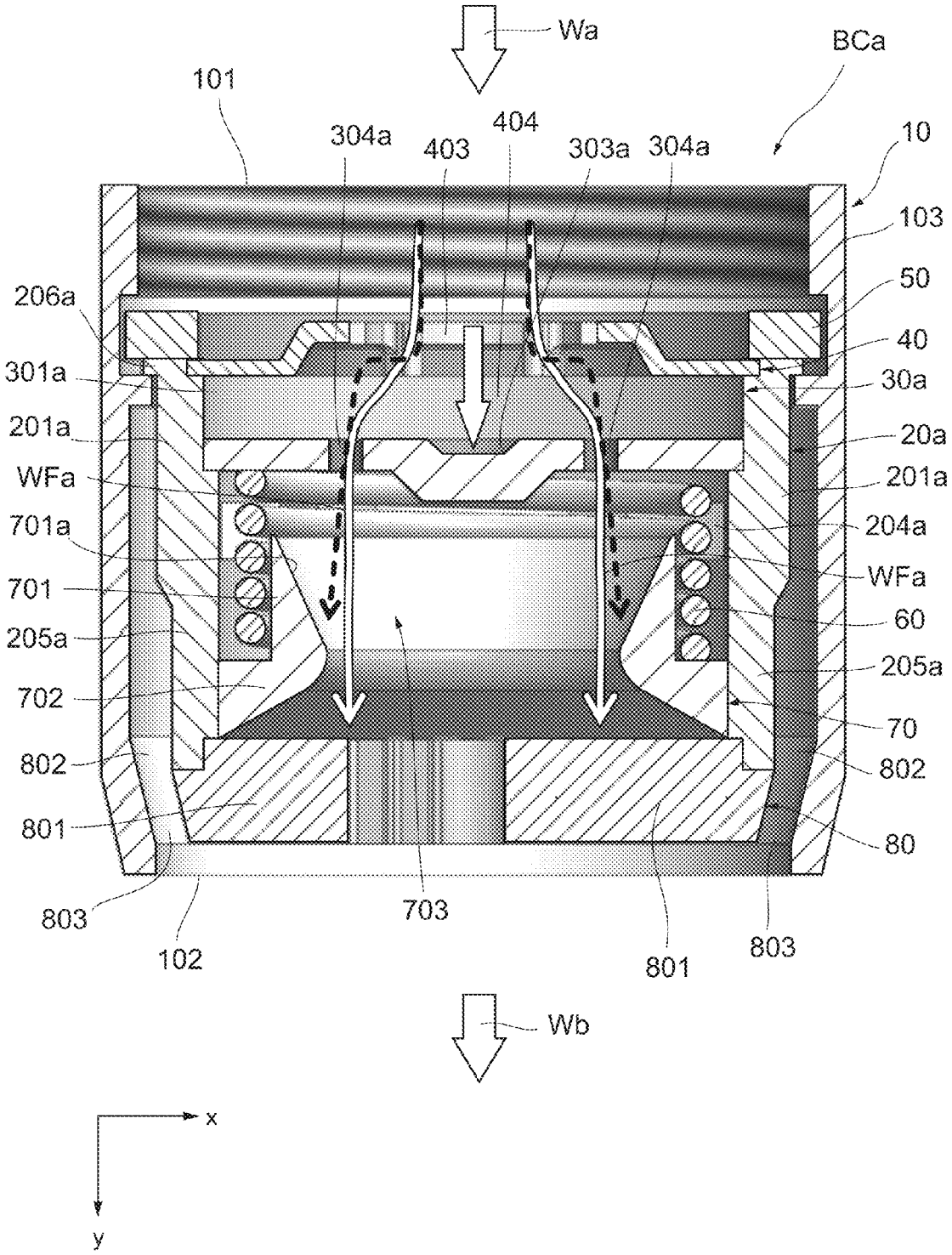
FIG. 7 is a cross-sectional view showing the spout cap according to the first modification of the first embodiment of the present invention.

Now, a spout cap BCa serving as a first modification of the spot cap BC according to the present embodiment will be described with reference to FIG. 6 and FIG. 7. FIG. 6 and FIG. 7 are cross-sectional views of the spout cap BCa serving as the first modification. In the spout cap BC, the pressure reducing portion 30 includes the blocking wall 305 configured to block the air holes 204, and is moved to vary the opening area of the air holes 204 to adjust the entrainment rate. However, the entrainment rate adjusting portion for varying the entrainment rate of the air bubbles entrained in the air bubble entrained water is not limited to this configuration. A configuration is also preferable in which an increase in entrainment rate is restrained by suppressing the efficiency at which air bubbles are entrained in the water. The spout cap BCa is an example of a configuration for suppressing the entrainment efficiency of air bubbles.

As shown in FIG. 6, the spout cap BCa includes a first cylindrical portion 10 (main body portion), a second cylindrical portion 20*a*, a pressure reducing portion 30*a* (entrainment rate adjusting portion and air amount adjusting portion), an upper reduced diameter portion 40 (attenuation portion), a packing 50, a spring 60, a lower reduced diameter portion 70, and a rectification portion 80.

The first cylindrical portion 10 is a generally cylindrical member with a cylindrical shape in which the second cylindrical portion 20*a*, the pressure reducing portion 30*a*, the upper reduced diameter portion 40, the packing 50, and the spring 60 are accommodated; the first cylindrical portion 10 functions as the main body portion. An attaching threaded portion 103 is provided on the upper end side, in FIG. 6, of the first cylindrical portion 10 (a terminal side in a negative direction in the y axis direction). The attaching threaded portion 103 is an internal thread allowing the spout cap BCa to be attached to a spout of a spout portion B2. The packing 50 is annularly provided under the attaching threaded portion 103 (in a positive direction in the y axis direction) along an inner wall of the first cylindrical portion 10. The packing 50 is a tight contact member for preventing possible water leakage when the spout cap BCa is attached to the spout of the spout portion B2.

When the spout cap BCa is attached to the spout of the spout portion B2 by threadedly fitting the attaching threaded portion 103 of the first cylindrical portion 10 onto an external thread of the spout of the spout portion B2, water Wa supplied by a water faucet device FC is fed from an inflow port 101. The water Wa flows from the inflow port 101 into the first cylindrical portion 10 serving as the main body portion. The water Wa then passes through an internal channel (the channel extending through the second cylindrical portion 20*a*, the pressure reducing portion 30*a*, the upper reduced diameter portion 40, the lower reduced diameter portion 70, and the rectification portion 80; the internal channel will be described below in detail) in the first cylindrical portion 10 to become water Wb, that is, air bubble entrained water or rectified water (water entrained with substantially no air bubbles). The water Wb is then discharged from a discharge port 102 to the exterior (bowl portion).

The upper reduced diameter portion 40 is arranged downstream of the packing 50 (the upper reduced diameter portion 40 is arranged closer to the discharge port 102 in the positive direction in the y axis direction). The upper reduced diameter portion 40 includes an annular flange portion 401 forming an outer circumference like a flange of a cap and an annular protruding portion 402 surrounded by the flange portion 401 and formed in an area of the upper reduced diameter portion 40 including the center thereof. The flange portion 401 is fixed to the second cylindrical portion 20*a*. This prevents the upper reduced diameter portion 40 and the pressure reducing portion 30*a* from moving integrally. Only the pressure reducing portion 30*a* moves independently.

The annular protruding portion 402 is formed so as to project upstream from the flange portion 401 (the annular protruding portion 402 is formed so as to project toward the inflow port 101 in the negative direction in the y axis direction). An inflow hole 403 is formed in an area of the annular protruding portion 402 including the center thereof. Inflow water from the inflow port 101 impinges on the upper reduced diameter portion 40, thus allowing a variation in the pressure of the water to be attenuated. The resultant inflow water is then allowed to flow out downstream from the inflow hole 403. The water flowing out downstream from the inflow hole 403 flows into a water storage portion 404 formed between the upper reduced diameter portion 40 and the pressure reducing portion 30*a*.

The pressure reducing portion 30*a* is arranged downstream of the upper reduced diameter portion 40. The pressure reducing portion 30*a* is formed of a pressure reducing plate 301*a* (pressure receiving plate). The pressure reducing plate 301*a* is a disk-shaped member.

A plurality of injection holes 304*a* (orifice portion) are annularly formed in the pressure reducing plate 301*a*. The plurality of injection holes 304*a* are formed at positions corresponding to the water storage portion 404. Hence, the plurality of injection holes 304*a* are formed so as not to be blocked by the flange portion 401 of the upper reduced diameter portion 40.

A recess portion 303*a* is formed in an area of the pressure reducing plate 301*a* including the center thereof. The recess portion 303*a* is formed in an upstream surface of the pressure reducing plate 301*a*. Thus, water flowing out downstream from the inflow hole 403 in the upper reduced diameter portion 40 is converged and centered by the recess portion 303*a* to act on the pressure reducing plate 301*a* so as to push down the pressure reducing plate 301*a* along the y axis direction. The water flowing out downstream from the inflow hole 403 in the upper reduced diameter portion 40 widens toward an outer circumferential direction and is then injected downstream from the plurality of injection holes 304*a*.

The second cylindrical portion 20*a* is provided between the first cylindrical portion 10 and both the upper reduced diameter portion 40 and the pressure reducing portion 30*a*. The second cylindrical portion 20*a* includes an upstream first guide portion 201*a* and a downstream second guide portion 205*a*.

A recess portion with which the upper reduced diameter portion 40 is engaged is formed at an upper end 206*a* of the first guide portion 201*a* (the end located closer to the inflow port 101 in the negative direction in the y axis direction). The pressure reducing plate 301*a* is arranged inside the first guide portion 201*a* such that the outer circumference of the pressure reducing plate 301*a* abuts on the first guide portion 201*a*. The pressure reducing plate 301*a* of the pressure reducing portion 30*a* is configured to move up and down along an inner wall surface of the first guide portion 201*a* (the pressure reducing plate 301*a* is configured to move in a direction along the y axis).

Air holes 204*a* (opening portion) configured to introduce air into the internal channel are formed between the first guide portion 201*a* and the second guide portion 205*a*. The air holes 204*a* are formed between the first guide portion 201*a* and the second guide portion 205*a* so as to be scattered all over the circumference of the second cylindrical portion 20*a*.

A space is formed between the first cylindrical portion 10 and the second cylindrical portion 20*a* as an air channel 802. The area between a downstream end of the first cylindrical portion 10 and a downstream end of the second cylindrical portion 20*a* is open and is formed as an air introduction port 803. Air introduced from the air introduction port 803 is introduced from the air holes 204*a* into the internal channel through the air channel 802.

The lower reduced diameter portion 70 is arranged inside the second guide portion 205*a*. The lower reduced diameter portion 70 is a cylindrical member including a reduced diameter taper portion 701 and an increased diameter taper portion 702. The reduced diameter taper portion 701 is provided upstream of the increased diameter taper portion 702 and formed such that the width of the internal channel decreases from the upstream side to the downstream side. The increased diameter taper portion 702 is provided downstream of the reduced diameter taper portion 701 and formed such that the width of the internal channel increases from the upstream side to the downstream side.

An inclined surface 701*a* of the reduced diameter taper portion 701 which is an inner surface thereof is formed at a position corresponding to the plurality of injection holes 304*a* in the pressure reducing portion 30*a*. Thus, a water flow WFa injected from the plurality of injection holes 304*a* in the pressure reducing plate 301*a* impinges on the inclined surface 701*a* and is thus directed inward to become a water flow WFb. The water flow WFb then gushes into a gas-liquid interface.

When water fed from the inflow port 101 is injected from the plurality of injection holes 304*a* in the pressure reducing plate 301*a*, the water starts to be filled in the spout cap from the downstream side. Then, a gas-liquid interface is formed at a position corresponding to the lower reduced diameter portion 70. The water flow WFb directed by the inclined surface 701*a* gushes into the gas-liquid surface while being entrained with air. Thus, air bubble entrained water is generated. The pressure reducing plate 301*a* acts to exert a negative pressure between the pressure reducing plate 301*a* and the lower reduced diameter portion 70. Hence, air is drawn in through the air holes 204*a* and gushes into the gas-liquid interface together with the water injected from the plurality of injection holes 304*a*. The water flow gushing into the gas-liquid interface disturbs the gas-liquid interface and thus becomes more likely to be entrained with air bubbles. Thus, the area extending from the pressure reducing plate 301*a* to the lower reduced diameter portion 70 is formed as an air bubble entraining portion 703.

The air bubble entrained water generated by the air bubble entraining portion 703 is rectified by a rectification grid 801 of the rectification portion 80 provided downstream of the second guide portion 205*a*. The rectified air bubble entrained water is then discharged from the discharge port 102 to the exterior.

The spring 60 serving as bias means is arranged between the pressure reducing portion 30*a* and the lower reduced diameter portion 70. The spring 60 is arranged so as to wind externally around the reduced diameter taper portion 701 of the lower reduced diameter portion 70.

Thus, when the water fed from the inflow port 101 flows through the inflow hole 403 in the upper reduced diameter portion 40 and impinges on the pressure reducing plate 301*a* of the pressure reducing portion 30*a*, the pressure reducing portion 30*a* is subjected to a force to push down the pressure reducing portion 30*a* from the upstream side to the downstream side. The spring 60 is arranged to resist this force, and thus the pressure reducing plate 301*a* moves as follows. The pressure reducing plate 301*a* remains stationary until a predetermined flow rate of water is fed from the inflow port 101 (or moves to the degree that the air holes 204 are not blocked) and moves downward when the flow rate of the water fed from the inflow port 101 exceeds the predetermined value.

FIG. 7 shows that the pressure reducing plate 301*a* has moved downward. As shown in FIG. 7, when the inflow water from the inflow port 101 exceeds the predetermined flow rate, the force of the inflow water Wa to push the pressure reducing plate 301*a* (pressure receiving plate) downstream (in the positive direction in the y axis direction) overcomes the force of the spring 60 to push the pressure reducing plate 301*a* upstream (in the negative direction in the y axis direction). Thus, the pressure reducing plate 301*a* moves downward from the initial position thereof. Moreover, the water flow WFa injected from the plurality of injection holes 304*a* travels more straight and thus gushes directly into the gas-liquid interface without impinging on the inclined surface 701*a* of the reduced diameter taper portion 701.

A comparison of FIG. 6 with FIG. 7 indicates as follows. In a state shown in FIG. 6, the water flow WFa injected from the plurality of injection holes 304*a* is divided into a number of water flows WFb upon impinging on the inclined surface 701*a*. The water flows WFb then gush into the gas-liquid interface. On the other hand, in a state shown in FIG. 7, the water flow WFa injected from the plurality of injection holes 304*a* gushes directly into the gas-liquid interface. Thus, the spout cap BCa is configured such that when the amount of the inflow water from the inflow port 101 exceeds a predetermined value, the total extension length decreases over which the outer circumference of the water flow gushing into the gas-liquid interface contacts the gas-liquid interface.

As described above, in the spout cap BCa, the water injected from the plurality of injection holes 304*a* serving as the orifice portion gushes into the gas-liquid interface while being entrained with air. Thus, the water is subjected to entrainment of the air and incorporation thereof resulting from deformation of the gas-liquid interface. Under these effects, air bubble entrained water is generated. Hence, utilizing a variation in the amount of incorporated air which is dependent on the length of the outer circumference of the water flow gushing into the gas-liquid interface, the spout cap reduces the total extension length over which the outer circumference of the water flow gushing into the gas-liquid interface contacts the gas-liquid interface to suppress the entrainment efficiency when the inflow water from the inflow port 101 exceeds the predetermined flow rate.

Thus, when the inflow water from the inflow port 101 exceeds the predetermined flow rate, the entrainment efficiency with which the air bubble entraining portion 703 entrains air bubbles into the water is suppressed to suppress an increase in entrainment rate. Hence, the entrainment rate is adjusted simply by regulating the entrainment efficiency, corresponding to the easiness with which water and air are mixed together, without the need to adjust the amount of air drawn in or the amount of water supplied. Therefore, an increase in entrainment rate can be more easily suppressed.

Figure 8:
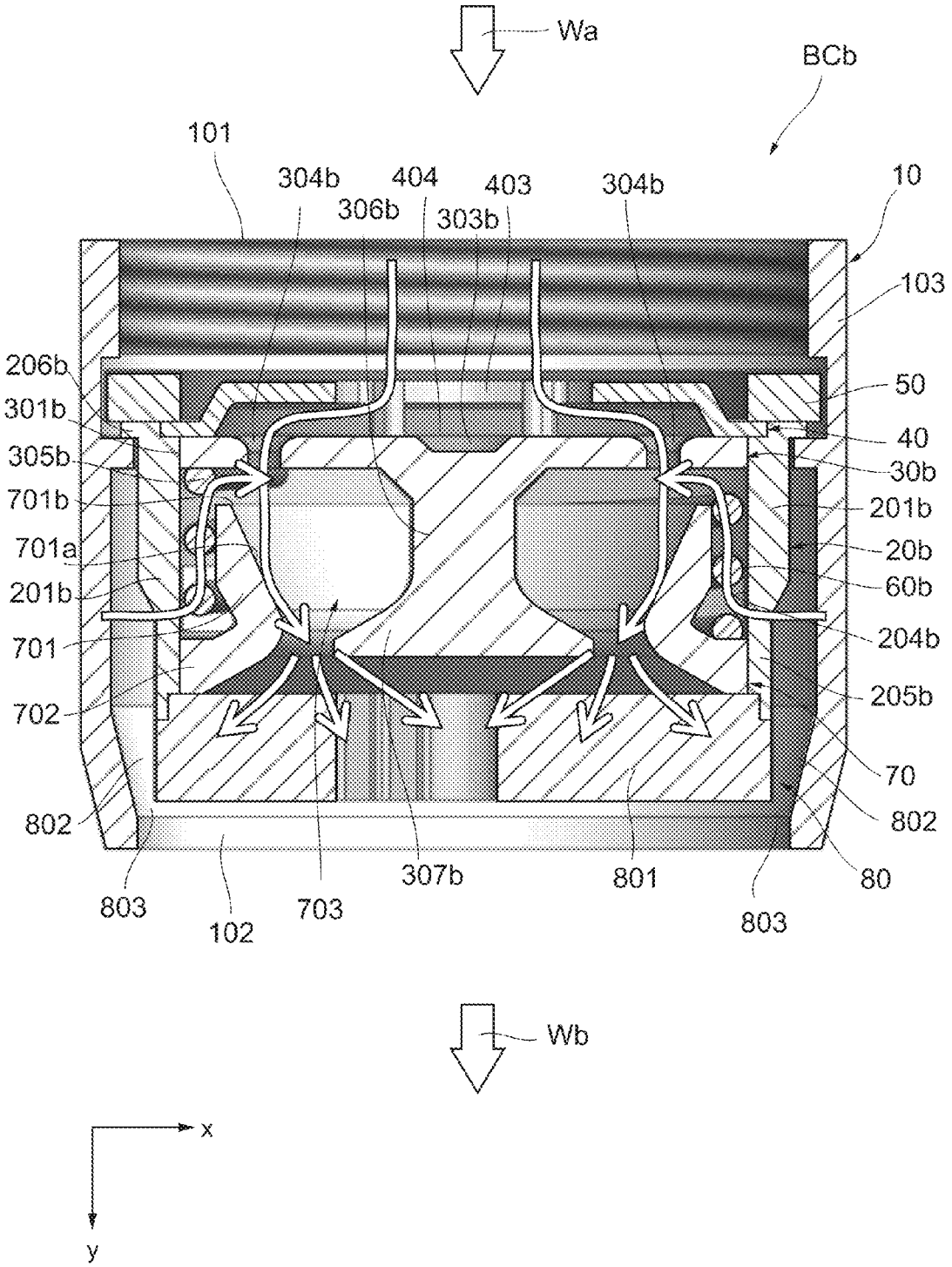
FIG. 8 is a cross-sectional view showing a spout cap according to a second modification of the first embodiment of the present invention.
Figure 9:
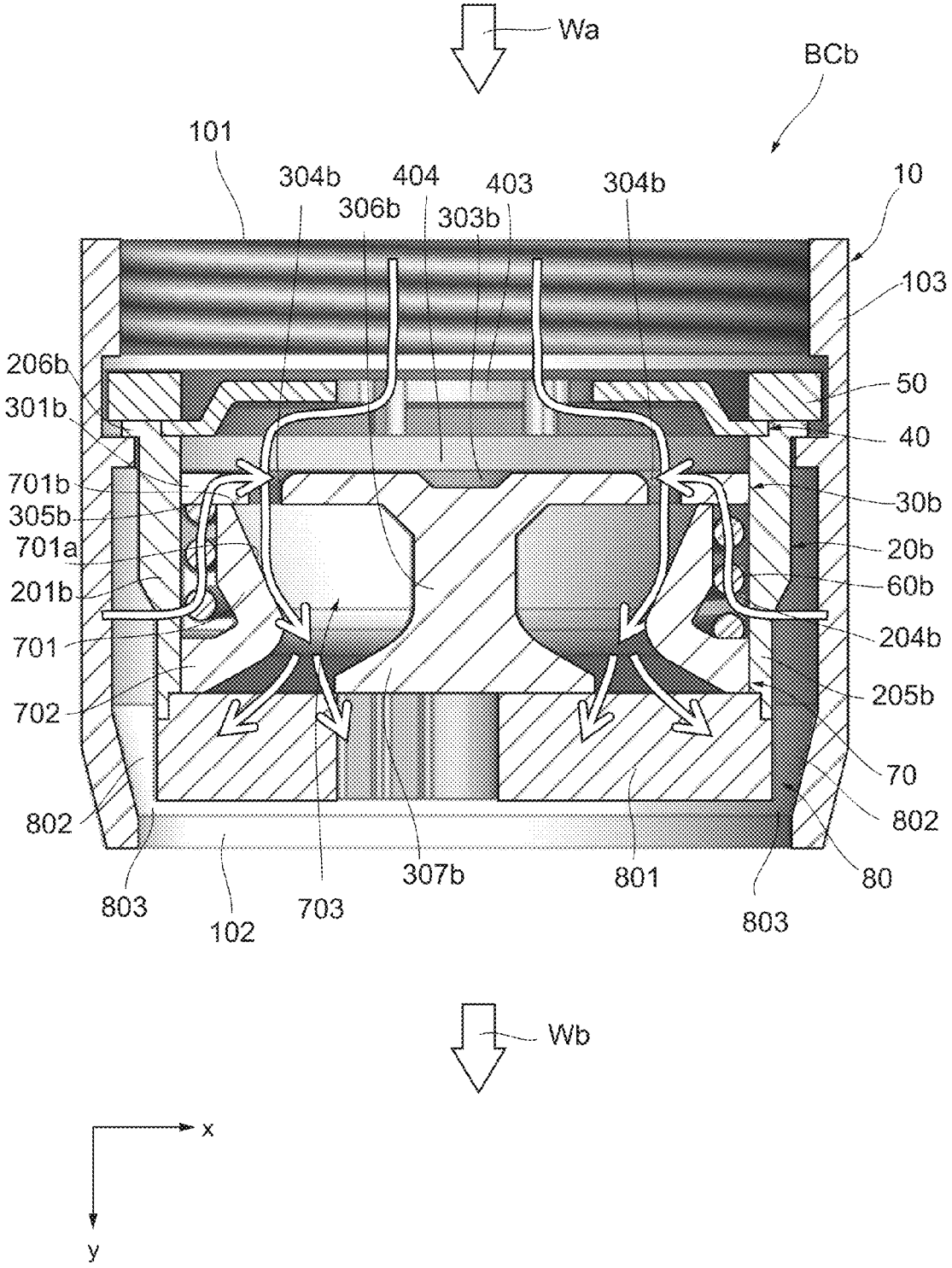
FIG. 9 is a cross-sectional view showing the spout cap according to the second modification of the first embodiment of the present invention.

Now, a spout cap BCb serving as a second modification of the spot cap BC according to the present embodiment will be described with reference to FIG. 8 and FIG. 9. FIG. 8 and FIG. 9 are cross-sectional views of the spout cap BCb serving as the second modification. In the spout cap BC, the pressure reducing portion 30 includes the blocking wall 305 configured to block the air holes 204, and is moved to vary the opening area of the air holes 204 to adjust the entrainment rate. However, the entrainment rate adjusting portion for varying the entrainment rate of the air bubbles entrained in the air bubble entrained water is not limited to this configuration. A configuration is also preferable in which an increase in entrainment rate is suppressed by increasing the internal pressure of the air bubble entraining portion. The spout cap BCb is an example of a configuration for increasing the internal pressure of the air bubble entraining portion to suppress the entrainment efficiency of air bubbles.

As shown in FIG. 8, the spout cap BCb includes a first cylindrical portion 10 (main body portion), a second cylindrical portion 20*b*, a pressure reducing portion 30*b* (entrainment rate adjusting portion and air amount adjusting portion), an upper reduced diameter portion 40 (attenuation portion), a packing 50, a spring 60, a lower reduced diameter portion 70, and a rectification portion 80.

The first cylindrical portion 10 is a generally cylindrical member with a cylindrical shape in which the second cylindrical portion 20*b*, the pressure reducing portion 30*b*, the upper reduced diameter portion 40, the packing 50, and the spring 60 are accommodated; the first cylindrical portion 10 functions as the main body portion. An attaching threaded portion 103 is provided on the upper end side, in FIG. 8, of the first cylindrical portion 10 (a terminal side in a negative direction in the y axis direction). The attaching threaded portion 103 is an internal thread allowing the spout cap BCb to be attached to a spout of a spout portion B2. The packing 50 is annularly provided under the attaching threaded portion 103 (in a positive direction in the y axis direction) along an inner wall of the first cylindrical portion 10. The packing 50 is a tight contact member for preventing possible water leakage when the spout cap BCb is attached to the spout of the spout portion B2.

When the spout cap BCb is attached to the spout of the spout portion B2 by threadedly fitting the attaching threaded portion 103 of the first cylindrical portion 10 onto an external thread of the spout of the spout portion B2, water Wa supplied by a water faucet device FC is fed from an inflow port 101. The water Wa flows from the inflow port 101 into the first cylindrical portion 10 serving as the main body portion. The water Wa then passes through an internal channel (the channel extending through the second cylindrical portion 20*b*, the pressure reducing portion 30*b*, the upper reduced diameter portion 40, the lower reduced diameter portion 70, and the rectification portion 80; the internal channel will be described below in detail) in the first cylindrical portion 10 to become water Wb, that is, air bubble entrained water or rectified water (water entrained with substantially no air bubbles). The water Wb is then discharged from a discharge port 102 to the exterior (bowl portion).

The upper reduced diameter portion 40 is arranged downstream of the packing 50 (the upper reduced diameter portion 40 is arranged closer to the discharge port 102 in the positive direction in the y axis direction). The upper reduced diameter portion 40 includes an annular flange portion 401 forming an outer circumference like a flange of a cap and an annular protruding portion 402 surrounded by the flange portion 401 and formed in an area of the upper reduced diameter portion 40 including the center thereof. The flange portion 401 is fixed to the second cylindrical portion 20*b*. This prevents the upper reduced diameter portion 40 and the pressure reducing portion 30*b* from moving integrally. Only the pressure reducing portion 30*b* moves independently.

The annular protruding portion 402 is formed so as to project upstream from the flange portion 401 (the annular protruding portion 402 is formed so as to project toward the inflow port 101 in the negative direction in the y axis direction). An inflow hole 403 is formed in an area of the annular protruding portion 402 including the center thereof. Inflow water from the inflow port 101 impinges on the upper reduced diameter portion 40, thus allowing a pressure of the water to be attenuated. The resultant inflow water is then allowed to flow out downstream from the inflow hole 403. The water flowing out downstream from the inflow hole 403 flows into a water storage portion 404 formed between the upper reduced diameter portion 40 and the pressure reducing portion 30*a*.

The pressure reducing portion 30*b* is arranged downstream of the upper reduced diameter portion 40. The pressure reducing portion 30*b* includes a pressure reducing plate 301*b* (pressure receiving plate), a connection portion 306*b*, and an increased diameter portion 307*b*. The pressure reducing plate 301*a* is a disk-shaped member. The connection portion 306*b* is provided to connect the pressure reducing plate 301*b* and the increased diameter portion 307*b* together. The connection portion 306*b* extends from a downstream surface of the pressure reducing plate 301*b* toward the rectification portion 80. The increased diameter portion 307*b* is adapted to increase the channel resistance in the rectification portion 80; the increased diameter portion 307*b* is a disk-shaped portion with a larger diameter than the connection portion 306*b*.

A plurality of injection holes 304*b* (orifice portion) are annularly formed in the pressure reducing plate 301*b*. The plurality of injection holes 304*b* are formed at positions corresponding to the water storage portion 404. Hence, the plurality of injection holes 304*b* are formed so as not to be blocked by the flange portion 401 of the upper reduced diameter portion 40.

A recess portion 303*b* is formed in an area of the pressure reducing plate 301*b* including the center thereof. The recess portion 303*b* is formed in an upstream surface of the pressure reducing plate 301*b*. Thus, water flowing out downstream from the inflow hole 403 in the upper reduced diameter portion 40 is converged and centered by the recess portion 303*b* to act on the pressure reducing plate 301*b* so as to push down the pressure reducing plate 301*b* along the y axis direction. The water flowing out downstream from the inflow hole 403 in the upper reduced diameter portion 40 widens toward an outer circumferential direction and is then injected downstream from the plurality of injection holes 304*b*.

The second cylindrical portion 20*b* is provided between the first cylindrical portion 10 and both the upper reduced diameter portion 40 and the pressure reducing portion 30*b*. The second cylindrical portion 20*b* includes an upstream first guide portion 201*b* and a downstream second guide portion 205*b*.

A recess portion with which the upper reduced diameter portion 40 is engaged is formed at an upper end 206*b* of the first guide portion 201*b* (the end located closer to the inflow port 101 in the negative direction in the y axis direction). The pressure reducing plate 301*b* is arranged inside the first guide portion 201*b* such that the outer circumference of the pressure reducing plate 301*b* abuts on the first guide portion 201*b*. The pressure reducing plate 301*b* of the pressure reducing portion

30*b* is configured to move up and down along an inner wall surface of the first guide portion 201*b* (the pressure reducing plate 301*b* is configured to move in a direction along the y axis).

Air holes 204*b* configured to introduce air into the internal channel are formed between the first guide portion 201*b* and the second guide portion 205*b*. The air holes 204*b* are formed between the first guide portion 201*b* and the second guide portion 205*b* so as to be scattered all over the circumference of the second cylindrical portion 20*b*.

A space is formed between the first cylindrical portion 10 and the second cylindrical portion 20*b* as an air channel 802. The area between a downstream end of the first cylindrical portion 10 and a downstream end of the second cylindrical portion 20*b* is open and is formed as an air introduction port 803. Air introduced from the air introduction port 803 is introduced from the air holes 204*b* into the internal channel through the air channel 802.

The lower reduced diameter portion 70 is arranged inside the second guide portion 205*b*. The lower reduced diameter portion 70 is a cylindrical member including a reduced diameter taper portion 701 and an increased diameter taper portion 702. The reduced diameter taper portion 701 is provided upstream of the increased diameter taper portion 702 and formed such that the width of the internal channel decreases from the upstream side to the downstream side. The increased diameter taper portion 702 is provided downstream of the reduced diameter taper portion 701 and formed such that the width of the internal channel increases from the upstream side to the downstream side.

An inclined surface 701*a* of the reduced diameter taper portion 701 which is an inner surface thereof is formed at a position corresponding to the plurality of injection holes 304*b* in the pressure reducing portion 30*b*. Thus, a water flow injected from the plurality of injection holes 304*b* in the pressure reducing plate 301*b* impinges on the inclined surface 701*a* and is thus divided into a number of water flows and directed inward. The resultant water flows gush into a gas-liquid interface.

An upper end 701*b* of the reduced diameter taper portion 701 is formed to be able to come into abutting contact with the lowered pressure reducing plate 301*b*. Thus, when the pressure reducing plate 301*b* lowers to come into abutting contact with the upper end 701*b* of the reduced diameter taper portion 701, the feeding, into the air bubble entraining portion 703, of air introduced from the air holes 204 is regulated.

When water fed from the inflow port 101 is injected from the plurality of injection holes 304*b* in the pressure reducing plate 301*b*, the water starts to be filled in the spout cap from the downstream side. Then, a gas-liquid interface is formed at a position corresponding to the lower reduced diameter portion 70. The water flow directed by the inclined surface 701*a* gushes into the gas-liquid surface while being entrained with air. Thus, air bubble entrained water is generated. The pressure reducing plate 301*b* acts to exert a negative pressure between the pressure reducing plate 301*b* and the lower reduced diameter portion 70. Hence, air is drawn in through the air holes 204*b* and gushes into the gas-liquid interface together with the water injected from the plurality of injection holes 304*b*. The water flow gushing into the gas-liquid interface disturbs the gas-liquid interface and thus becomes more likely to be entrained with air bubbles. Thus, the area extending from the pressure reducing plate 301*b* to the lower reduced diameter portion 70 is formed as an air bubble entraining portion 703.

The air bubble entrained water generated by the air bubble entraining portion 703 is rectified by a rectification grid 801 of the rectification portion 80 provided downstream of the second guide portion 205*b*. The rectified air bubble entrained water is then discharged from the discharge port 102 to the exterior.

The spring 60*b* serving as bias means is arranged between the pressure reducing portion 30*b* and the lower reduced diameter portion 70. The spring 60*b* is arranged so as to wind externally around the reduced diameter taper portion 701 of the lower reduced diameter portion 70.

Thus, when the water fed from the inflow port 101 flows through the inflow hole 403 in the upper reduced diameter portion 40 and impinges on the pressure reducing plate 301*b* of the pressure reducing portion 30*b*, the pressure reducing portion 30*b* is subjected to a force to push down the pressure reducing portion 30*b* from the upstream side to the downstream side. The spring 60*b* is arranged to resist this force, and thus the pressure reducing plate 301*b* moves as follows. The pressure reducing plate 301*b* remains stationary until a predetermined flow rate of water is fed from the inflow port 101 (or moves to the degree that the air holes 204*b* are not blocked) and moves downward when the flow rate of the water fed from the inflow port 101 exceeds the predetermined value.

FIG. 9 shows that the pressure reducing plate 301*b* has moved downward. As shown in FIG. 9, when the inflow water from the inflow port 101 exceeds the predetermined flow rate, the force of the inflow water Wa to push the pressure reducing plate 301*b* (pressure receiving plate) downstream (in the positive direction in the y axis direction) overcomes the force of the spring 60*b* to push the pressure reducing plate 301*b* upstream (in the negative direction in the y axis direction). Thus, the pressure reducing plate 301*b* moves downward from the initial position thereof. In conjunction with the movement of the pressure reducing plate 301*b*, the increased diameter portion 307*b* moves to block a part of the rectification portion 80 to increase the channel resistance in the rectification portion 80. Moreover, when the pressure reducing plate 301*b* comes into abutting contact with the upper end 701*b* of the reduced diameter taper portion 701, the supply of air is stopped.

In the spout cap BCb, the rectification portion 80 is provided between the air bubble entraining portion 703 and the discharge port 102; the rectification portion 80 is configured to converge and rectify air bubble entrained water generated by the air bubble entraining portion 703. Thus, bubbly water can be spouted in a neat and clean manner. Furthermore, the channel resistance in the rectification portion 80 is increased to increase the internal pressure in the air bubble entraining portion 703. Hence, the entrainment rate of air bubbles can be adjusted using the simple configuration without the need to install a separate device for increasing the channel resistance.

In the spout cap BCb, the pressure reducing portion 30*b* functioning as the entrainment rate adjusting portion includes the pressure reducing plate 301*b* serving as the pressure receiving plate that receives, in an area of the pressure reducing plate including the center thereof, the water flowing out from the attenuation portion 40. The pressure reducing plate 301*b* is further configured to advance and retract freely along the internal channel under the force exerted by the water received by the pressure reducing plate 301*b*. Thus, even if the pressure of the inflow water from the inflow port 101 varies, the pressure reducing plate 301*b* receives the varying pressure in the area of the pressure reducing plate 301*b* including the center thereof. As a result, the pressure reducing portion 30*b* can move stably along the internal channel without being tilted. When the amount of the water received by the pressure reducing plate 301*b* exceeds a threshold water amount, the pressure reducing portion 30*b* serving as the entrainment rate adjusting portion moves so as to reduce the cross-sectional area of the internal channel in the rectification portion 80. Hence, the entrainment rate of air bubbles can be adjusted using the simple and stable configuration.

Figure 10:
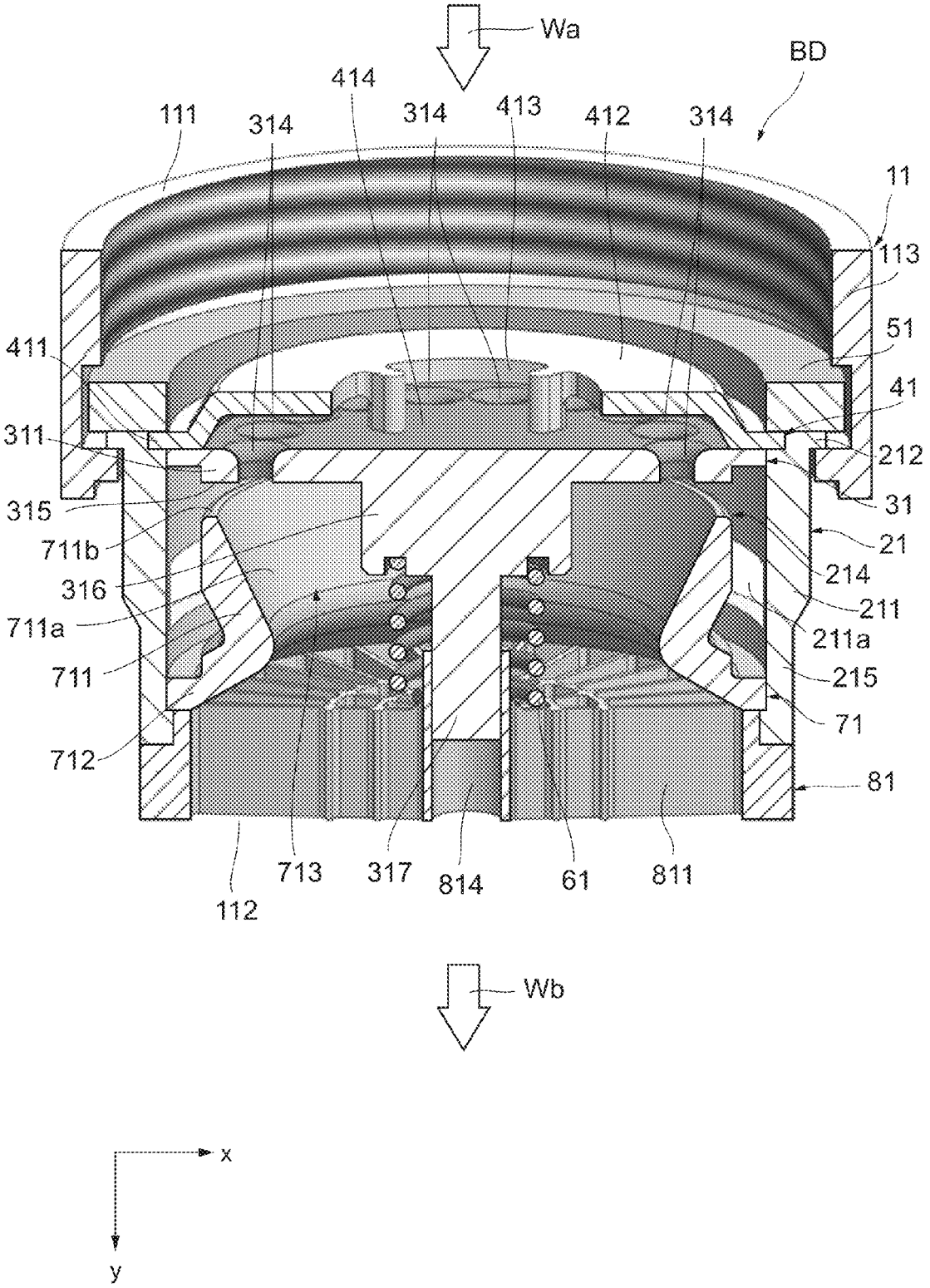
FIG. 10 is a cross-sectional view showing a spout cap according to a second embodiment of the present invention.
Figure 11:
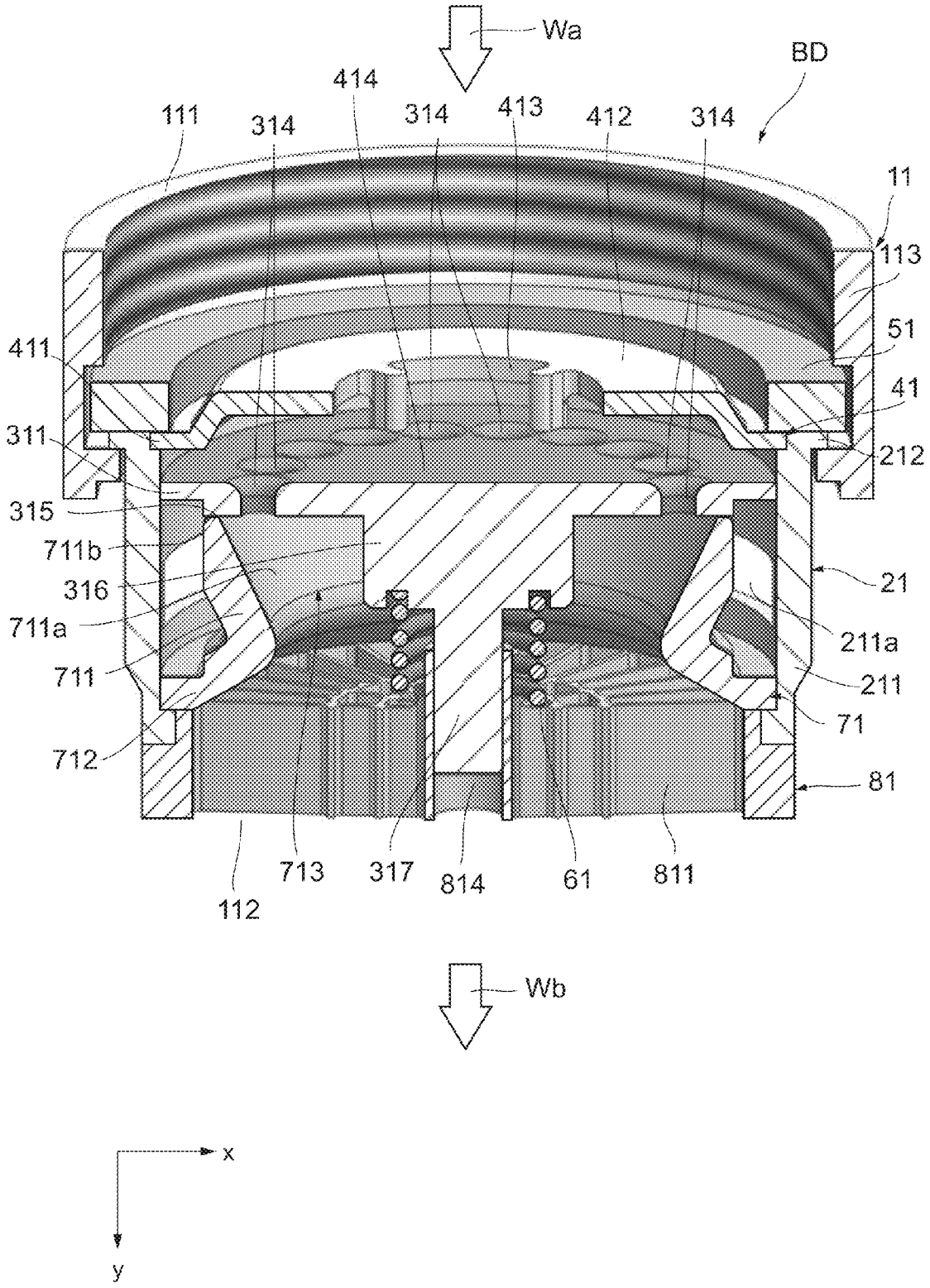
FIG. 11 is a cross-sectional view showing the spout cap according to the second embodiment of the present invention.

Now, a spout cap BD according to a second embodiment of the present invention will be described with reference to FIG. 10 and FIG. 11. FIG. 10 and FIG. 11 are cross-sectional views of the spout cap BD serving as the second embodiment.

As shown in FIG. 10, the spout cap BD includes a first cylindrical portion 11 (main body portion), a second cylindrical portion 21 (main body portion), a pressure reducing portion 31 (entrainment rate adjusting portion and air amount adjusting portion), an upper reduced diameter portion 41 (attenuation portion), a packing 51, a spring 61, a lower reduced diameter portion 71, and a rectification portion 81 (main body portion).

The first cylindrical portion 11 is a generally cylindrical member with a cylindrical shape in which the packing 51 is accommodated, with the second cylindrical portion 21 and rectification portion 81 provided so as to extend downstream from the packing 51. Thus, in the present embodiment, the first cylindrical portion 11, the second cylindrical portion 21, and the rectification portion 81 form the main body portion. An attaching threaded portion 113 is provided on the upper end side, in FIG. 10, of the first cylindrical portion 11 (a terminal side in a negative direction in the y axis direction). The attaching threaded portion 113 is an internal thread allowing the spout cap BD to be attached to a spout of a spout portion B2. The packing 51 is annularly provided under the attaching threaded portion 113 (in a positive direction in the y axis direction) along an inner wall of the first cylindrical portion 11. The packing 51 is a tight contact member for preventing possible water leakage when the spout cap BD is attached to the spout of the spout portion B2.

When the spout cap BD is attached to the spout of the spout portion B2 by threadedly fitting the attaching threaded portion 113 of the first cylindrical portion 11 onto an external thread of the spout of the spout portion B2, water Wa supplied by a water faucet device FC is fed from an inflow port 111. The water Wa flows from the inflow port 111 into the first cylindrical portion 11 serving as the main body portion. The water Wa then passes through the internal channel in the first cylindrical portion 11 (the channel extending through the second cylindrical portion 21, the pressure reducing portion 31, the upper reduced diameter portion 41, the lower reduced diameter portion 71, and the rectification portion 81; the internal channel will be described below in detail) to become water Wb, that is, air bubble entrained water or rectified water (water entrained with substantially no air bubbles). The water Wb is then discharged from a discharge port 112 to the exterior (bowl portion).

The upper reduced diameter portion 41 is arranged downstream of the packing 51 (the upper reduced diameter portion 41 is arranged closer to the discharge port 112 in the positive direction in the y axis direction). The upper reduced diameter portion 41 includes an annular flange portion 411 forming an outer circumference like a flange of a cap and an annular protruding portion 412 surrounded by the flange portion 411 and formed in an area of the upper reduced diameter portion 41 including the center thereof. The flange portion 411 is fixed to the second cylindrical portion 21. This prevents the upper reduced diameter portion 41 and the pressure reducing portion 31 from moving integrally. Only the pressure reducing portion 31 moves independently.

The annular protruding portion 412 is formed so as to project upstream from the flange portion 411 (the annular protruding portion 412 is formed so as to protrude toward the inflow port 111 in the negative direction in the y axis direction). An inflow hole 413 is formed in an area of the annular protruding portion 412 including the center thereof. Inflow water from the inflow port 111 impinges on the upper reduced diameter portion 41, thus allowing a pressure of the water to be attenuated. The resultant inflow water is then allowed to flow out downstream from the inflow hole 413. The water flowing out downstream from the inflow hole 413 flows into a water storage portion 414 formed between the upper reduced diameter portion 41 and the pressure reducing portion 31.

The pressure reducing portion 31 is arranged downstream of the upper reduced diameter portion 41. The pressure reducing portion 31 includes a pressure reducing plate 311 (pressure receiving plate), a large-diameter projecting portion 316 and a small-diameter projecting portion 317. The pressure reducing plate 311 is a disk-shaped member. The large-diameter projecting portion 316 extends from a downstream surface of the pressure reducing plate 311 toward the rectification portion 81. The small-diameter projecting portion 317 extends downstream from the large-diameter projecting portion 316 toward the rectification portion 80. Thus, the large-diameter projecting portion 316 and the small-diameter projecting portion 307 are formed to project from the pressure reducing plate 311 as a stepped rod.

A plurality of injection holes 314 (orifice portion) are annularly formed in the pressure reducing plate 311. The plurality of injection holes 314 are formed at positions corresponding to the water storage portion 414. Hence, the plurality of injection holes 314 are formed so as not to be blocked by the flange portion 411 of the upper reduced diameter portion 41.

The second cylindrical portion 21 is provided outside the upper reduced diameter portion 41 and the pressure reducing portion 31 and downstream of the first cylindrical portion 11. The second cylindrical portion 21 includes an upstream first guide portion 211 and a downstream second guide portion 215.

A recess portion with which the upper reduced diameter portion 41 is engaged is formed at an upper end 212 of the first guide portion 211 (the end located closer to the inflow port 111 in the negative direction in the y axis direction). The pressure reducing plate 311 is arranged inside the first guide portion 211 such that the outer circumference of the pressure reducing plate 311 abuts on the first guide portion 211. The pressure reducing plate 311 of the pressure reducing portion 31 is configured to move up and down along an inner wall surface of the first guide portion 211 (the pressure reducing plate 311 is configured to move in a direction along the y axis).

Air holes 211*a* configured to introduce air into the internal channel are formed between the first guide portion 211 and the second guide portion 215. The air holes 211*a* are formed between the first guide portion 211 and the second guide portion 215 so as to be scattered all over the circumference of the second cylindrical portion 21.

The lower reduced diameter portion 71 is arranged inside the second guide portion 215. The lower reduced diameter portion 71 is a cylindrical member including a reduced diameter taper portion 711 and an increased diameter taper portion 712. The reduced diameter taper portion 711 is provided upstream of the increased diameter taper portion 712 and formed such that the width of the internal channel decreases from the upstream side to the downstream side. The increased diameter taper portion 712 is provided downstream of the reduced diameter taper portion 711 and formed such that the width of the internal channel increases from the upstream side to the downstream side.

An inclined surface 711*a* of the reduced diameter taper portion 711 which is an inner surface thereof is formed at a position corresponding to the plurality of injection holes 314 in the pressure reducing portion 31. Thus, a water flow injected from the plurality of injection holes 314 in the pressure reducing plate 311 impinges on the inclined surface 711*a* and is thus directed inward. The resultant water flow gushes into a gas-liquid interface.

An upper end 711*b* of the reduced diameter taper portion 711 is formed to be able to come into abutting contact with the lowered pressure reducing plate 311. Thus, when the pressure reducing plate 311 lowers to come into abutting contact with the upper end 711*b* of the reduced diameter taper portion 711, the feeding, into the air bubble entraining portion 713, of air introduced from the air holes 211*a* is regulated. Consequently, in the present embodiment, gaps 214 between the upper end 711*b* of the reduced diameter taper portion 711 and the pressure reducing plate 311 also function as the opening portion.

When water fed from the inflow port 111 is injected from the plurality of injection holes 314 in the pressure reducing plate 311, the water starts to be filled in the spout cap from the downstream side. Then, a gas-liquid interface is formed at a position corresponding to the lower reduced diameter portion 71. The water flow directed by the inclined surface 711*a* gushes into the gas-liquid surface while being entrained with air. Thus, air bubble entrained water is generated. The pressure reducing plate 311 acts to exert a negative pressure between the pressure reducing plate 311 and the lower reduced diameter portion 71. Hence, air is drawn in through the air holes 211*a* and the gaps 214 and gushes into the gas-liquid interface together with the water injected from the plurality of injection holes 314. The water flow gushing into the gas-liquid interface disturbs the gas-liquid interface and thus becomes more likely to be entrained with air bubbles. Thus, the area extending from the pressure reducing plate 311 to the lower reduced diameter portion 71 is formed as an air bubble entraining portion 713.

The air bubble entrained water generated by the air bubble entraining portion 713 is rectified by a rectification grid 811 of the rectification portion 81 provided downstream of the second guide portion 215. The rectified air bubble entrained water is then discharged from the discharge port 112 to the exterior.

The spring 61 serving as bias means is arranged between the pressure reducing portion 31 and the rectification portion 81. The spring 61 is arranged so as to wind externally around the small-diameter projecting portion 317 of the pressure reducing portion 31. The small-diameter projecting portion 317 is inserted through a guide hole 814 formed in the center of the rectification portion 81.

Thus, when the water fed from the inflow port 111 flows through the inflow hole 413 in the upper reduced diameter portion 41 and impinges on the pressure reducing plate 311 of the pressure reducing portion 31, the pressure reducing portion 31 is subjected to a force to push down the pressure reducing portion 31 from the upstream side to the downstream side. The spring 61 is arranged to resist this force, and thus the pressure reducing plate 311 moves as follows. The pressure reducing plate 311 remains stationary until a predetermined flow rate of water is fed from the inflow port 111 (or moves to the degree that the gaps 214 are not blocked) and moves downward when the flow rate of the water fed from the inflow port 111 exceeds the predetermined value.

FIG. 11 shows that the pressure reducing plate 311 has moved downward. As shown in FIG. 11, when the inflow water from the inflow port 111 exceeds the predetermined flow rate, the force of the inflow water Wa to push the pressure reducing plate 311 (pressure receiving plate) downstream (in the positive direction in the y axis direction) overcomes the force of the spring 61 to push the pressure reducing plate 311 upstream (in the negative direction in the y axis direction). Thus, the pressure reducing plate 311 moves downward from the initial position thereof. In conjunction with the movement of the pressure reducing plate 311, the gaps 214 are narrowed to regulate the feeding of the air into the air bubble entraining portion 713. Moreover, when the pressure reducing plate 311 comes into abutting contact with the upper end 711*b* of the reduced diameter taper portion 711 and the gaps 214 are blocked, the supply of air is stopped.

As described above, the spout cap BD (water spouting device) according to the present embodiment enables air bubble entrained water to be discharged. The spout cap BD includes the first cylindrical portion 11 (main body portion) with the discharge port 112 formed therein and from which the water Wb is discharged, the inflow port 111 formed therein and into which the water Wa to be discharged from the discharge port 112 flows from a water supply source, and the internal channel formed therein and extending from the inflow port 111 to the discharge port 112; the second cylindrical portion 21; the rectification portion 81 (main body portion); the plurality of injection holes 314 (orifice portion) configured to inject the inflow water from the inflow port 111 toward a downstream side of the internal channel; the air bubble entraining portion 713 with the air holes 211*a* and gaps 214 (opening portion) formed therein and through which air is introduced into the internal channel, the air bubble entraining portion 713 entraining the air introduced from the air holes 211*a* and the gaps 214 into the water injected from the plurality of injection holes 314 to generate air bubble entrained water and supplying the air bubble entrained water to the discharge port 112; and the pressure reducing portion 31 (entrainment rate adjusting portion) configured to adjust the entrainment rate of air bubbles to be entrained into the air bubble entrained water in the air bubble entraining portion 713. The pressure reducing portion 31 functioning as the entrainment rate adjusting portion increases the entrainment rate until the inflow water from the inflow port 111 reaches the predetermined flow rate. The pressure reducing portion 31 suppresses an increase in entrainment rate when the inflow water from the inflow port 111 exceeds the predetermined flow rate. Therefore, the spout cap BD exerts advantageous effects similar to those of the spout cap BC according to the first embodiment.

Figure 12:
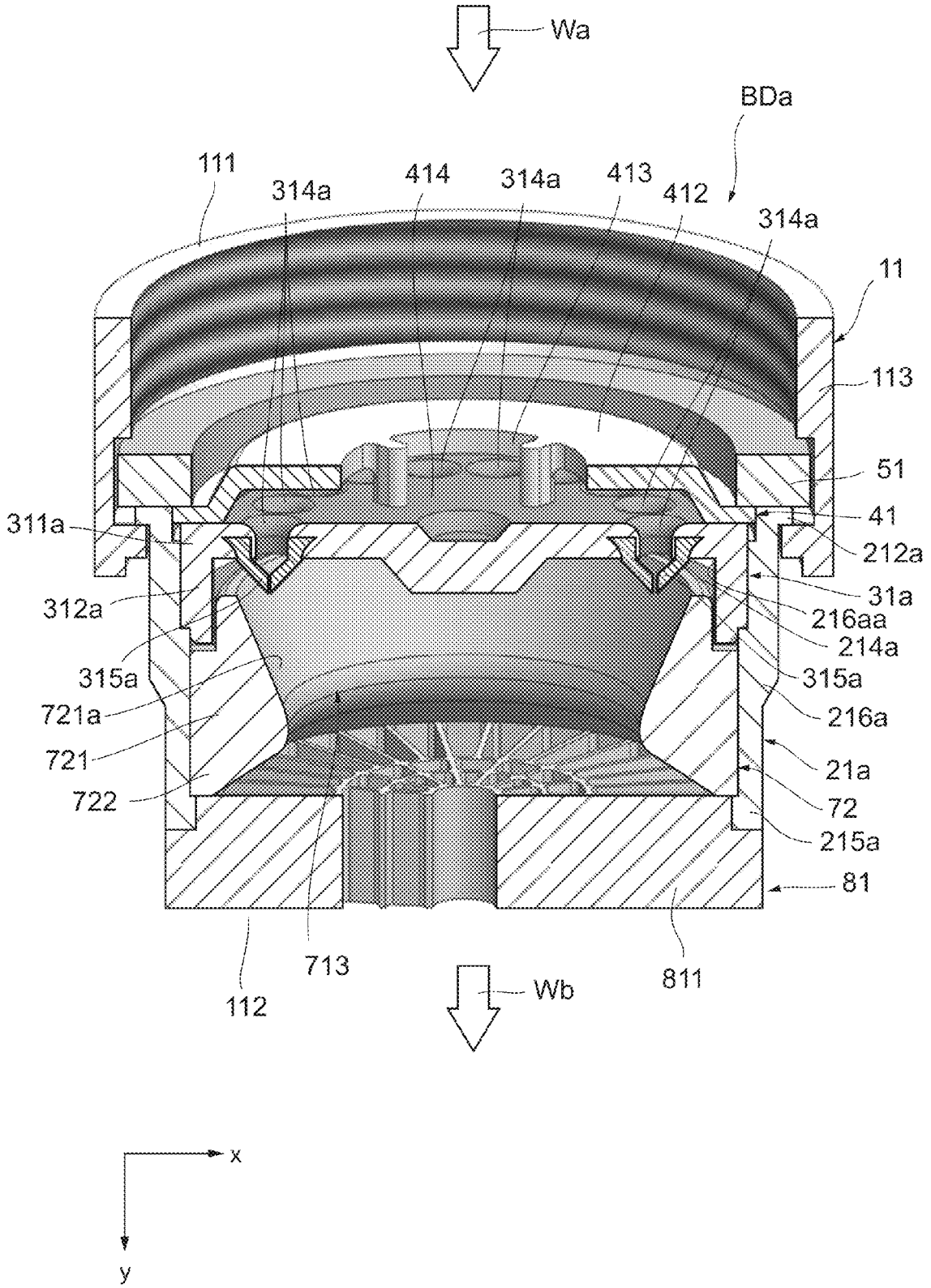
FIG. 12 is a cross-sectional view showing a spout cap according to a first modification of the second embodiment of the present invention.
Figure 13:
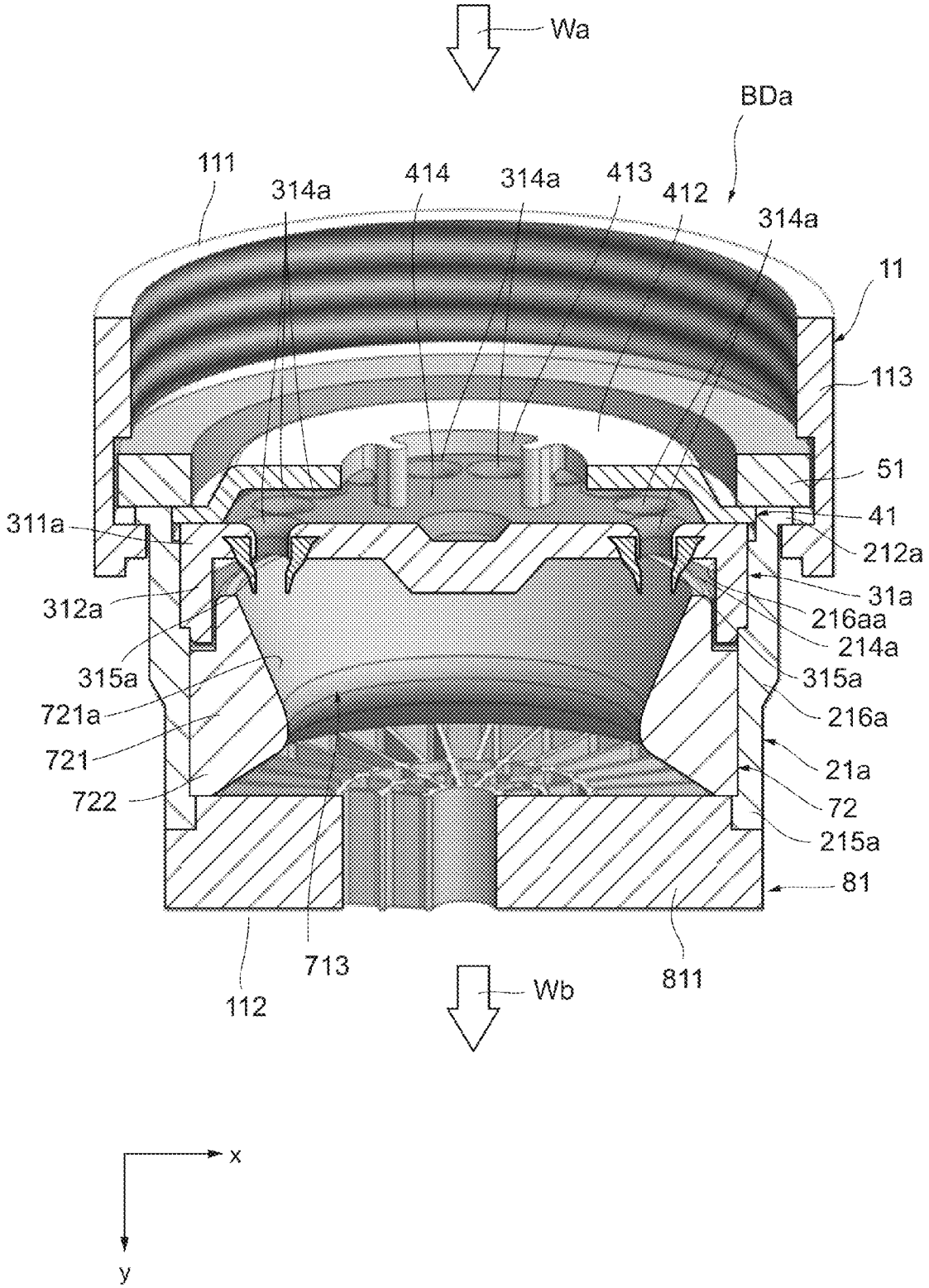
FIG. 13 is a cross-sectional view showing the spout cap according to the first modification of the second embodiment of the present invention.

Now, a spout cap BDa serving as a first modification of the spout cap BD according to the present embodiment will be described with reference to FIG. 12 and FIG. 13. FIG. 12 and FIG. 13 are cross-sectional views of the spout cap BDa serving as the first modification. In the spout cap BD, the gaps 214 are formed between the pressure reducing portion 31 and the lower reduced diameter portion 71. The pressure reducing portion 31 is moved to vary the opening area of the gaps 214 serving as the opening portion to adjust the entrainment rate. However, the entrainment rate adjusting portion for varying the entrainment rate of the air bubbles entrained in the air bubble entrained water is not limited to this configuration. A configuration is also preferable in which a force to draw in air is suppressed to restrain an increase in entrainment rate. The spout cap BDa is an example in which the entrainment efficiency of air bubbles is thus suppressed.

As shown in FIG. 12, the spout cap BDa includes a first cylindrical portion 11 (main body portion), a second cylindrical portion 21*a* (main body portion), a pressure reducing portion 31*a* (entrainment rate adjusting portion and air amount adjusting portion), an upper reduced diameter portion 41 (attenuation portion), a packing 51, a lower reduced diameter portion 72, and a rectification portion 81 (main body portion).

The first cylindrical portion 11 is a generally cylindrical member with a cylindrical shape in which the packing 51 is accommodated, with the second cylindrical portion 21*a* and rectification portion 81 provided so as to extend downstream from the packing 51. Thus, in the present embodiment, the first cylindrical portion 11, the second cylindrical portion 21*a*, and the rectification portion 81 form the main body portion. An attaching threaded portion 113 is provided on the upper end side, in FIG. 12, of the first cylindrical portion 11 (a terminal side in a negative direction in the y axis direction). The attaching threaded portion 113 is an internal thread allowing the spout cap BDa to be attached to a spout of a spout portion B2. The packing 51 is annularly provided under the attaching threaded portion 113 (in a positive direction in the y axis direction) along an inner wall of the first cylindrical portion 11. The packing 51 is a tight contact member for preventing possible water leakage when the spout cap BDa is attached to the spout of the spout portion B2.

When the spout cap BDa is attached to the spout of the spout portion B2 by threadedly fitting the attaching threaded portion 113 of the first cylindrical portion 11 onto an external thread of the spout of the spout portion B2, water Wa supplied by a water faucet device FC is fed from an inflow port 111. The water Wa flows from the inflow port 111 into the first cylindrical portion 11 serving as the main body portion. The water Wa then passes through the internal channel in the first cylindrical portion 11 (the channel extending through the second cylindrical portion 21*a*, the pressure reducing portion 31*a*, the upper reduced diameter portion 41, the lower reduced diameter portion 72, and the rectification portion 81; the internal channel will be described below in detail) to become water Wb, that is, air bubble entrained water or rectified water (water entrained with substantially no air bubbles). The water Wb is then discharged from a discharge port 112 to the exterior (bowl portion).

The upper reduced diameter portion 41 is arranged downstream of the packing 51 (the upper reduced diameter portion 41 is arranged closer to the discharge port 112 in the positive direction in the y axis direction). The upper reduced diameter portion 41 includes an annular flange portion 411 forming an outer circumference like a flange of a cap and an annular protruding portion 412 surrounded by the flange portion 411 and formed in an area of the upper reduced diameter portion 41 including the center thereof. The flange portion 411 is fixed to the second cylindrical portion 21*a*.

The annular protruding portion 412 is formed so as to project upstream from the flange portion 411 (the annular protruding portion 412 is formed so as to protrude toward the inflow port 111 in the negative direction in the y axis direction). An inflow hole 413 is formed in an area of the annular protruding portion 412 including the center thereof. Inflow water from the inflow port 111 impinges on the upper reduced diameter portion 41, thus allowing a pressure of the water to be attenuated. The resultant inflow water is then allowed to flow out downstream from the inflow hole 413. The water flowing out downstream from the inflow hole 413 flows into a water storage portion 414 formed between the upper reduced diameter portion 41 and the pressure reducing portion 31*a*.

The pressure reducing portion 31*a* is arranged downstream of the upper reduced diameter portion 41. The pressure reducing portion 31*a* includes a pressure reducing plate 311*a* (pressure receiving plate) and a lower projection 312*a*. The pressure reducing plate 311*a* is a disk-shaped member. The lower projection 312*a* extends downstream from an outer circumferential portion of the pressure reducing plate 311*a*. The lower projection 312*a* abuts on the second cylindrical portion 21*a* and the lower reduced diameter portion 72 to form gaps 214*a* between the lower reduced diameter portion 72 and the pressure reducing plate 311*a*.

A plurality of injection holes 314*a* (orifice portion) are annularly formed in the pressure reducing plate 311*a*. The plurality of injection holes 314*a* are formed at positions corresponding to the water storage portion 414. Hence, the plurality of injection holes 314*a* are formed so as not to be blocked by the flange portion 411 of the upper reduced diameter portion 41.

In the present example, duckbills 315*a* are provided in some of the plurality of injection holes 314*a*. The duckbills 315*a* are formed of a deformable member (for example, resin) so as to be opened to allow water to pass through when the amount of the water increases. The duckbills 315*a* are attached to a downstream surface of the pressure reducing plate 311*a*.

The second cylindrical portion 21*a* is provided outside the upper reduced diameter portion 41 and the pressure reducing portion 31*a* and downstream of the first cylindrical portion 11. The second cylindrical portion 21*a* includes an upstream first guide portion 216*a* and a downstream second guide portion 215*a*.

A recess portion with which the upper reduced diameter portion 41 is engaged is formed at an upper end 212*a* of the first guide portion 216*a* (the end located closer to the inflow port 111 in the negative direction in the y axis direction). The pressure reducing plate 311*a* and the lower projection 312*a* are arranged inside the first guide portion 216*a* such that the outer circumference of the pressure reducing plate 311*a* and the lower projection 312*a* abut on the first guide portion 216*a*.

Air holes 216*aa* configured to introduce air into the internal channel are formed between the first guide portion 216*a* and the second guide portion 215*a*. The air holes 216*aa* are formed between the first guide portion 216*a* and the second guide portion 215*a* so as to be scattered all over the circumference of the second cylindrical portion 21*a*.

The lower reduced diameter portion 72 is arranged inside the second guide portion 215*a*. The lower reduced diameter portion 72 is a cylindrical member including a reduced diameter taper portion 721 and an increased diameter taper portion 722. The reduced diameter taper portion 721 is provided upstream of the increased diameter taper portion 722 and formed such that the width of the internal channel decreases from the upstream side to the downstream side. The increased diameter taper portion 722 is provided downstream of the reduced diameter taper portion 721 and formed such that the width of the internal channel increases from the upstream side to the downstream side.

An inclined surface 721*a* of the reduced diameter taper portion 721 which is an inner surface thereof is formed at a position corresponding to the plurality of injection holes 314*a* in the pressure reducing portion 31*a*. Thus, a water flow injected from the plurality of injection holes 314*a* in the pressure reducing plate 311*a* impinges on the inclined surface 721*a* and is thus directed inward. The resultant water flow gushes into a gas-liquid interface.

When water fed from the inflow port 111 is injected from the plurality of injection holes 314*a* in the pressure reducing plate 311*a*, the water starts to be filled in the spout cap from the downstream side. Then, a gas-liquid interface is formed at a position corresponding to the lower reduced diameter portion 72. The water flow directed by the inclined surface 721*a* gushes into the gas-liquid surface while being entrained with air. Thus, air bubble entrained water is generated. The pressure reducing plate 311*a* acts to exert a negative pressure between the pressure reducing plate 311*a* and the lower reduced diameter portion 72. Hence, air is drawn in through the air holes 216*aa* and the gaps 214*a* and gushes into the gas-liquid interface together with the water injected from the plurality of injection holes 314*a*. The water flow gushing into the gas-liquid interface disturbs the gas-liquid interface and thus becomes more likely to be entrained with air bubbles. Thus, the area extending from the pressure reducing plate 311*a* to the lower reduced diameter portion 72 is formed as an air bubble entraining portion 713.

The air bubble entrained water generated by the air bubble entraining portion 713 is rectified by a rectification grid 811 of the rectification portion 81 provided downstream of the second guide portion 215*a*. The rectified air bubble entrained water is then discharged from the discharge port 112 to the exterior.

In the present embodiment, the duckbills 315*a* are attached to some of the plurality of the injection holes 314*a*. Thus, when the water fed from the inflow port 111 flows through the inflow hole 413 in the upper reduced diameter portion 41 to the injection holes 314*a* formed in the pressure reducing plate 311*a* of the pressure reducing portion 31*a*, the duckbills 315*a* are subjected to a force to push open the duckbills 135*a*. The duckbills 315*a* move as follows. The duckbills 315*a* remain closed until a predetermined flow rate of water is fed from the inflow port 111, and is opened when the flow rate of the water fed from the inflow port 111 exceeds a predetermined value.

FIG. 13 shows that the duckbills 315*a* are opened. As shown in FIG. 13, when the flow rate of the inflow water from the inflow port 111 exceeds the predetermined value, the force of the inflow water Wa to push open the duckbills 315*a* prevails to open the duckbills 315*a*. Then, water passes through the injection holes 314*a* to which the duckbills 315*a* are attached. As a result, in terms of the plurality of injection holes 314*a* as a whole, the opening area increases to suppress an increase in the flow velocity of the water injected from the plurality of injection holes 314*a*.

In the present example, the duckbills 315*a* are attached to some of the injection holes 314*a*. However, also preferably, the duckbill 315*a* with an opening pre-formed at the tip thereof is attached to all the injection holes 314*a*. This enables a configuration in which the opening areas of the individual injection holes 314*a* increase consistently with the amount of water.

As described above, when the inflow water from the inflow port 111 exceeds the predetermined flow rate, the opening area of the plurality of injection holes 314*a* is increased to suppress an increase in the flow velocity of the water injected from the plurality of injection holes 314*a*. Thus, an increase in the flow velocity of the water injected from the plurality of injection holes 314*a* can be suppressed using the simple configuration for increasing the total area of the plurality of injection holes 314*a* as a whole.

In other words, when the inflow water from the inflow port 111 exceeds the predetermined flow rate, an increase in the flow velocity of the water injected from the plurality of injection holes 314*a* is suppressed to restrain a force to draw in air through the air holes 216*aa* and gaps 214*a* serving as the opening portion. Hence, the single operation of suppressing an increase in the flow velocity of injected water additionally enables the amount of air introduced to be suppressed. This eliminates the need to provide a separate device such as a pump allowing a force to forcibly feed in air to be varied. As a result, an increase in entrainment rate can be reliably suppressed using the simpler configuration.

Figure 14:
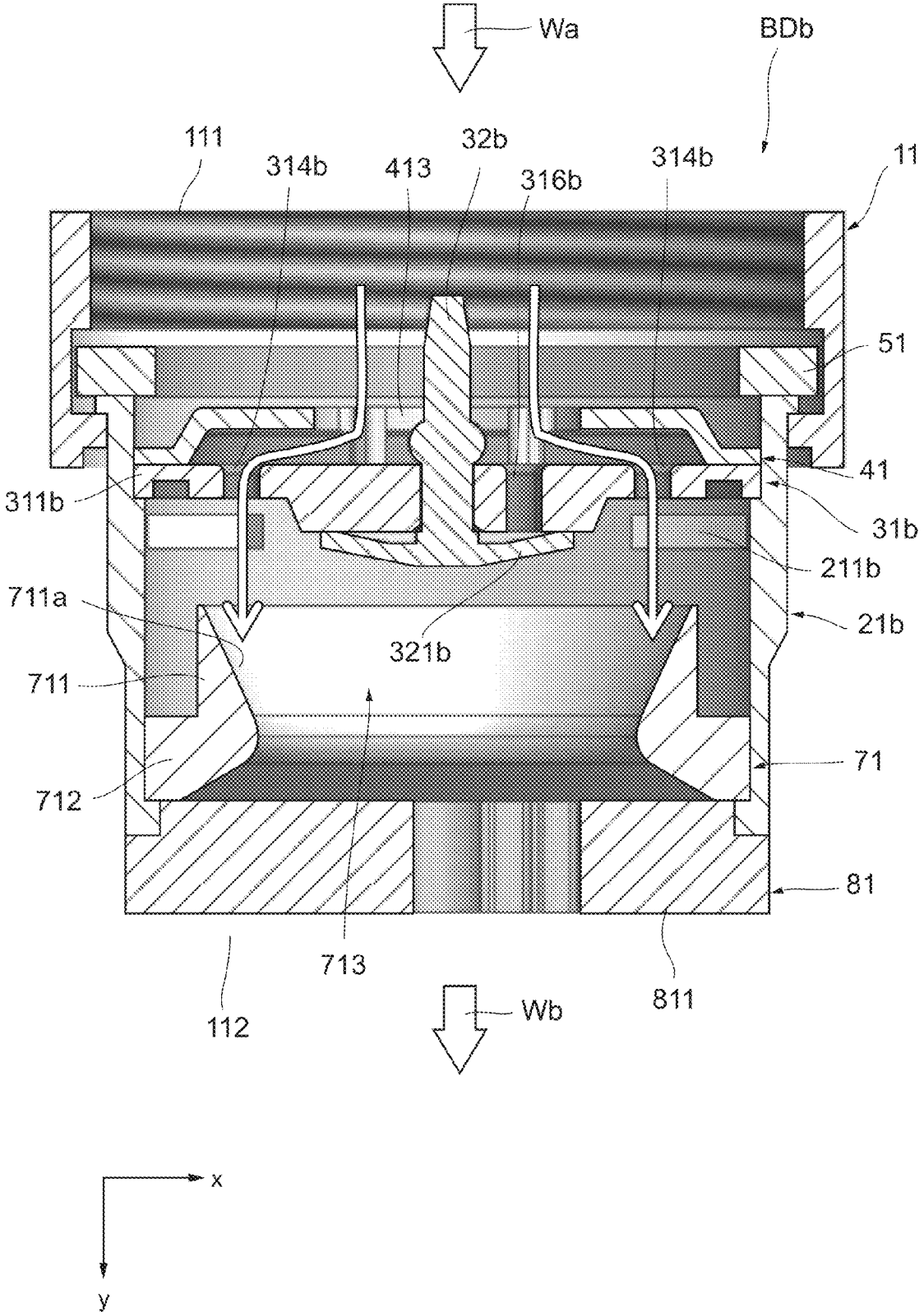
FIG. 14 is a cross-sectional view showing a spout cap according to a second modification of the second embodiment of the present invention.
Figure 15:
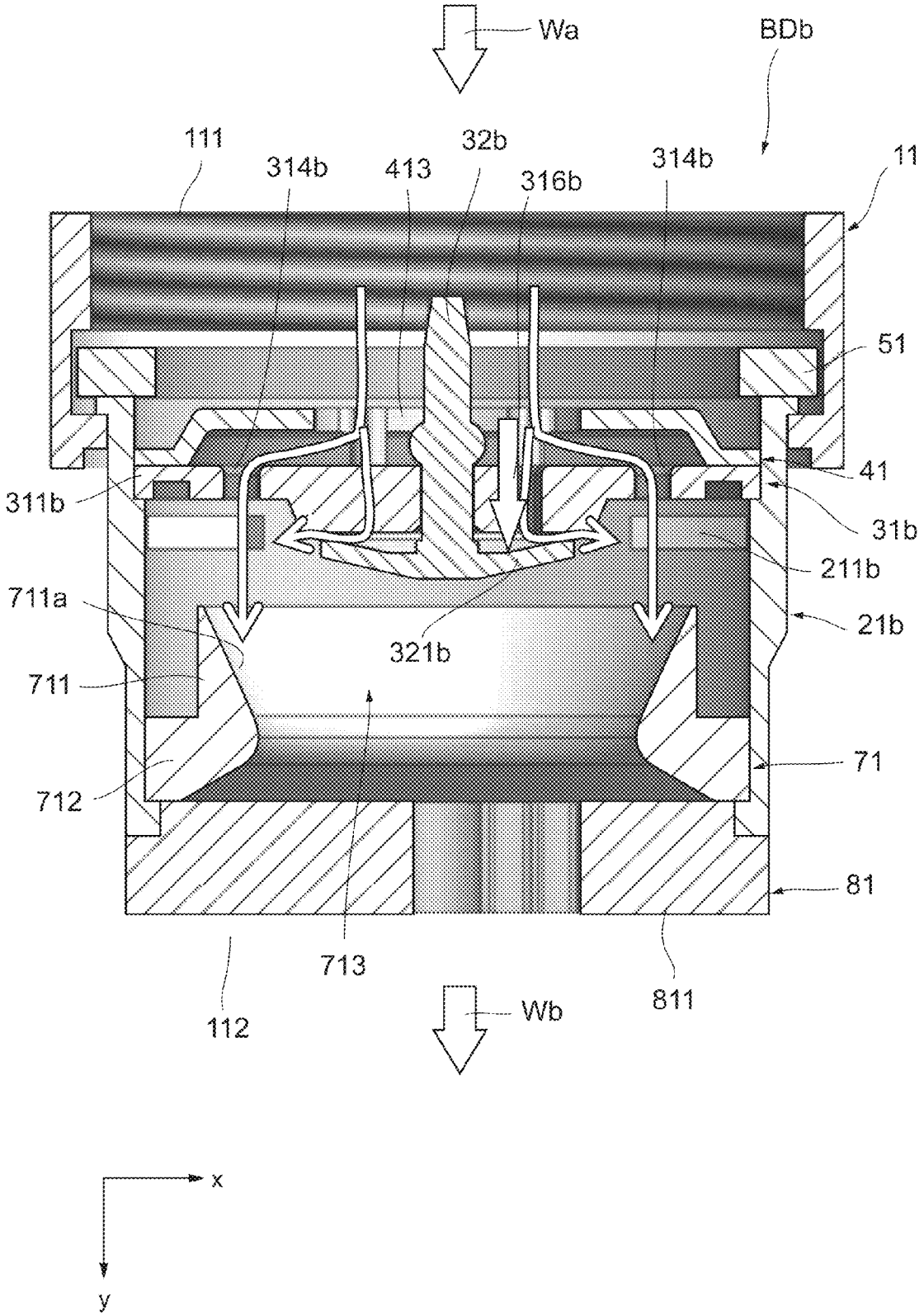
FIG. 15 is a cross-sectional view showing the spout cap according to the second modification of the second embodiment of the present invention.

In terms of suppression of the force to draw in air through the air holes 216*aa* and gaps 214*a* serving as the opening portion, a path other than the plurality of injection holes 314*a* is preferably formed downstream of the pressure reducing plate 311*a* so that water flows to and through the path. An example of this preferred aspect will be described with reference to FIG. 14 and FIG. 15. FIG. 14 and FIG. 15 are cross-sectional views of a spout cap BDb serving as a second modification.

As shown in FIG. 14, the spout cap BDb includes a first cylindrical portion 11 (main body portion), a second cylindrical portion 21*b* (main body portion), a pressure reducing portion 31*b* (entrainment rate adjusting portion and air amount adjusting portion), an upper reduced diameter portion 41 (attenuation portion), a packing 51, a lower reduced diameter portion 72, and a rectification portion 81 (main body portion).

The first cylindrical portion 11 is a generally cylindrical member with a cylindrical shape in which the packing 51 is accommodated, with the second cylindrical portion 21*b* and rectification portion 81 provided so as to extend downstream from the packing 51. Thus, in the present embodiment, the first cylindrical portion 11, the second cylindrical portion 21*b*, and the rectification portion 81 form the main body portion. An attaching threaded portion 113 is provided on the upper end side, in FIG. 14, of the first cylindrical portion 11 (a terminal side in a negative direction in the y axis direction). The attaching threaded portion 113 is an internal thread allowing the spout cap BDb to be attached to a spout of a spout portion B2. The packing 51 is annularly provided under the attaching threaded portion 113 (in a positive direction in the y axis direction) along an inner wall of the first cylindrical portion 11. The packing 51 is a tight contact member for preventing possible water leakage when the spout cap BDb is attached to the spout of the spout portion B2.

When the spout cap BDb is attached to the spout of the spout portion B2 by threadedly fitting the attaching threaded portion 113 of the first cylindrical portion 11 onto an external thread of the spout of the spout portion B2, water Wa supplied by a water faucet device FC is fed from an inflow port 111. The water Wa flows from the inflow port 111 into the first cylindrical portion 11 serving as the main body portion. The water Wa then passes through the internal channel in the first cylindrical portion 11 (the channel extending through the second cylindrical portion 21*b*, the pressure reducing portion 31*b*, the upper reduced diameter portion 41, the lower reduced diameter portion 72, and the rectification portion 81; the internal channel will be described below in detail) to become water Wb, that is, air bubble entrained water or rectified water (water entrained with substantially no air bubbles). The water Wb is then discharged from a discharge port 112 to the exterior (bowl portion).

The upper reduced diameter portion 41 is arranged downstream of the packing 51 (the upper reduced diameter portion 41 is arranged closer to the discharge port 112 in the positive direction in the y axis direction). The upper reduced diameter portion 41 includes an annular flange portion 411 forming an outer circumference like a flange of a cap and an annular protruding portion 412 surrounded by the flange portion 411 and formed in an area of the upper reduced diameter portion 41 including the center thereof. The flange portion 411 is fixed to the second cylindrical portion 21*b*.

The annular protruding portion 412 is formed so as to project upstream from the flange portion 411 (the annular protruding portion 412 is formed so as to protrude toward the inflow port 111 in the negative direction in the y axis direction). An inflow hole 413 is formed in an area of the annular protruding portion 412 including the center thereof. Inflow water from the inflow port 111 impinges on the upper reduced diameter portion 41, thus allowing a pressure of the water to be attenuated. The resultant inflow water is then allowed to flow out downstream from the inflow hole 413. The water flowing out downstream from the inflow hole 413 flows into a water storage portion 414 formed between the upper reduced diameter portion 41 and the pressure reducing portion 31*b*.

The pressure reducing portion 31*b* is arranged downstream of the upper reduced diameter portion 41. The pressure reducing portion 31*b* includes a pressure reducing plate 311*b* (pressure receiving plate) and an opening adjusting portion 32*b*. The pressure reducing plate 311*b* is a disk-shaped member. The opening adjusting portion 32*b* serves to increase the opening area of the pressure reducing plate 311*b* when the amount of the inflow water from the inflow port 111 increases.

A plurality of injection holes 314*b* (orifice portion) are annularly formed in the pressure reducing plate 311*b*. The plurality of injection holes 314*b* are formed at positions corresponding to the water storage portion 414. Hence, the plurality of injection holes 314*b* are formed so as not to be blocked by the flange portion 411 of the upper reduced diameter portion 41.

In the present example, besides the plurality of injection holes 314*b*, a water passing hole 316*b* is formed. An adjustment plate 321*b* of an opening adjusting portion 32*b* is provided so as to cover a downstream side of the water passing hole 316*b*. When the flow rate of the inflow water from the inflow port 111 exceeds a predetermined value, a gap is formed between the adjustment plate 321*b* and the pressure reducing plate 311*b*. Thus, water passes through the water passing hole 316*b*.

The second cylindrical portion 21*b* is provided outside the upper reduced diameter portion 41 and the pressure reducing portion 31*b* and downstream of the first cylindrical portion 11.

Air holes 211*b* configured to introduce air into the internal channel are formed in the second cylindrical portion 21*b*. The air holes 211*b* are formed so as to be scattered all over the circumference of the second cylindrical portion 21*b*.

The lower reduced diameter portion 71 is arranged inside and downstream of the second cylindrical portion 21*b*. The lower reduced diameter portion 71 is a cylindrical member including a reduced diameter taper portion 711 and an increased diameter taper portion 712. The reduced diameter taper portion 711 is provided upstream of the increased diameter taper portion 712 and formed such that the width of the internal channel decreases from the upstream side to the downstream side. The increased diameter taper portion 712 is provided downstream of the reduced diameter taper portion 711 and formed such that the width of the internal channel increases from the upstream side to the downstream side.

An inclined surface 711*a* of the reduced diameter taper portion 711 which is an inner surface thereof is formed at a position corresponding to the plurality of injection holes 314*b* in the pressure reducing portion 31*b*. Thus, a water flow injected from the plurality of injection holes 314*b* in the pressure reducing plate 311*b* impinges on the inclined surface 711*a* and is thus directed inward. The resultant water flow gushes into a gas-liquid interface.

When water fed from the inflow port 111 is injected from the plurality of injection holes 314*b* in the pressure reducing plate 311*b*, the water starts to be filled in the spout cap from the downstream side. Then, a gas-liquid interface is formed at a position corresponding to the lower reduced diameter portion 71. The water flow directed by the inclined surface 711*a* gushes into the gas-liquid surface while being entrained with air. Thus, air bubble entrained water is generated. The pressure reducing plate 311*b* acts to exert a negative pressure between the pressure reducing plate 311*b* and the lower reduced diameter portion 71. Hence, air is drawn in through the air holes 211*b* and gushes into the gas-liquid interface together with the water injected from the plurality of injection holes 314*b*. The water flow gushing into the gas-liquid interface disturbs the gas-liquid interface and thus becomes more likely to be entrained with air bubbles. Thus, the area extending from the pressure reducing plate 311*b* to the lower reduced diameter portion 71 is formed as an air bubble entraining portion 713.

The air bubble entrained water generated by the air bubble entraining portion 713 is rectified by a rectification grid 811 of the rectification portion 81 provided downstream of the air bubble entraining portion 713. The rectified air bubble entrained water is then discharged from the discharge port 112 to the exterior.

FIG. 15 shows that a gap has been formed between the adjustment plate 321*b* and the pressure reducing plate 311*b*. As shown in FIG. 15, when the inflow water from the inflow port 111 exceeds the predetermined flow rate, the force of the inflow water Wa to push the adjustment plate 321*b* prevails to separate the adjustment plate 321*b* from the pressure reducing plate 311*b*. Thus, water passes through the water passing hole 316*b*. As a result, a path other than the plurality of injection holes 314*b* is formed downstream of the pressure reducing plate 311*b* so that water flows to and through the path. All in all, the opening area increases to suppress an increase in the flow velocity of the water injected from the plurality of injection holes 314*b*.

Thus, since the path other than the plurality of injection holes 314*b* is formed to and through which water flows, when the inflow water from the inflow port 111 exceeds the predetermined amount, an increase in the flow velocity of the water injected from the plurality of injection holes 314*b* is suppressed. Hence, the water otherwise flowing through the plurality of injection holes 314*b* forming the orifice portion is passed through the path other than the plurality of injection holes 314*b*. This allows suppression of an increase in the amount of the water flowing through the plurality of holes 314*b*, reliably restraining an increase in the flow velocity of the water injected from the plurality of injection holes 314*b*.

Figure 16:
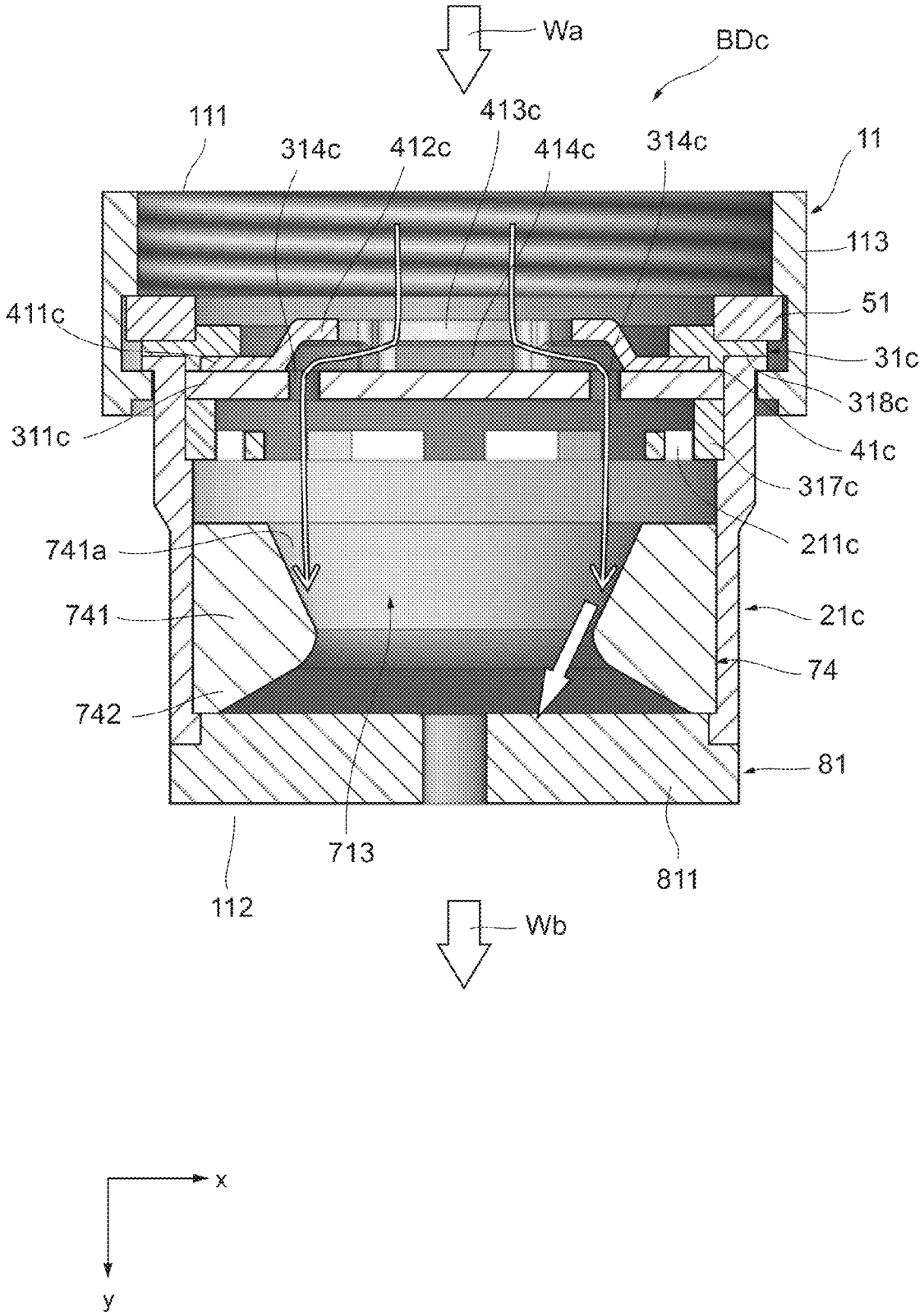
FIG. 16 is a cross-sectional view showing a spout cap according to a third modification of the second embodiment of the present invention.
Figure 17:
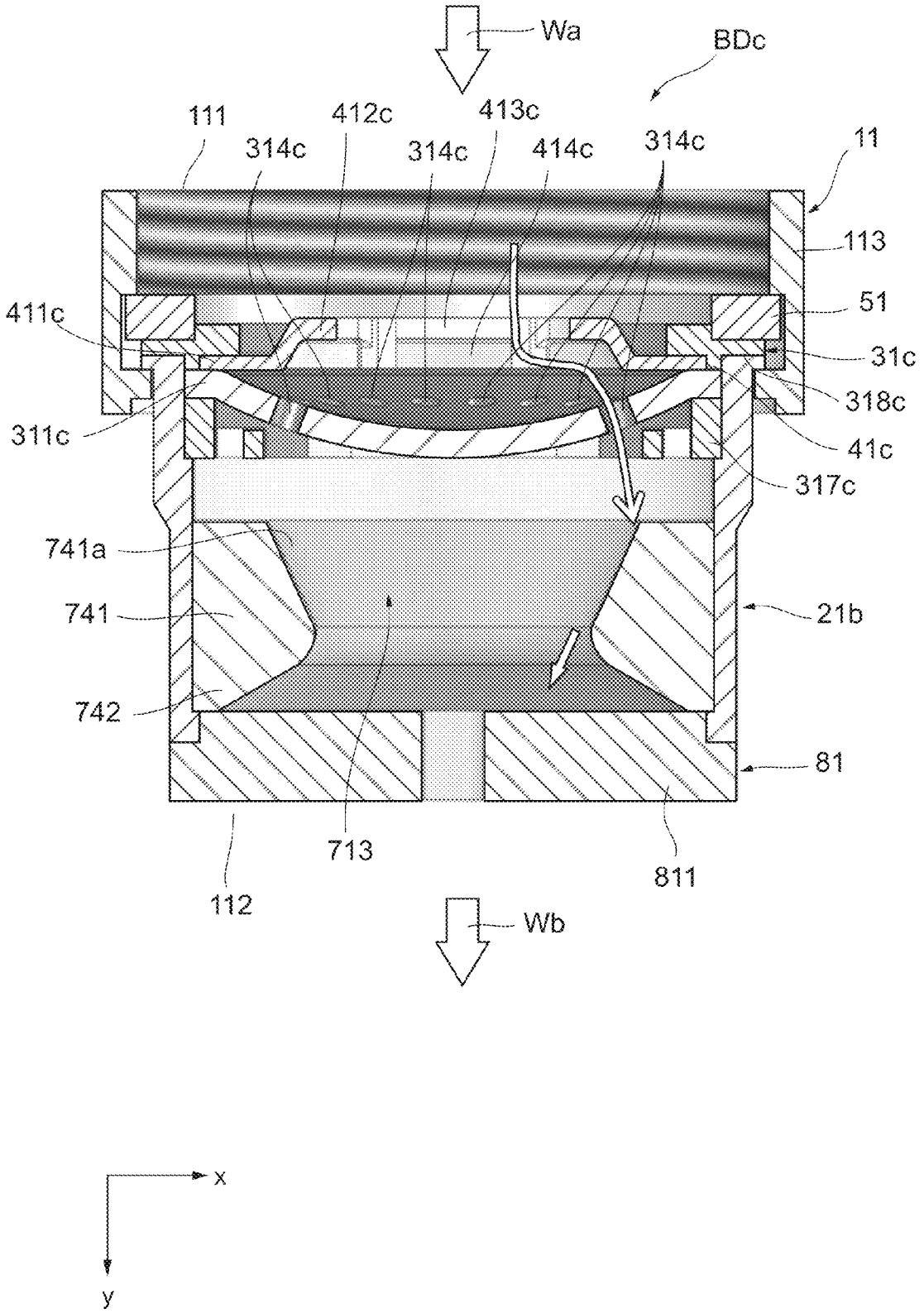
FIG. 17 is a cross-sectional view showing the spout cap according to the third modification of the second embodiment of the present invention.

In terms of suppression of the entrainment efficiency of air bubbles entrained in the air bubble entrained water and thus restraint of an increase in entrainment rate, an increase in the flow velocity of the water gushing into the gas-liquid field is preferably restrained. An example of this preferred aspect will be described below with reference to FIG. 16 and FIG. 17. FIG. 16 and FIG. 17 are cross-sectional views of a spout cap BDc serving as a third modification.

As shown in FIG. 16, the spout cap BDc includes a first cylindrical portion 11 (main body portion), a second cylindrical portion 21*c* (main body portion), a pressure reducing portion 31*c* (entrainment rate adjusting portion and air amount adjusting portion), an upper reduced diameter portion 41*c* (attenuation portion), a packing 51, a lower reduced diameter portion 74, and a rectification portion 81 (main body portion).

The first cylindrical portion 11 is a generally cylindrical member with a cylindrical shape in which the packing 51 is accommodated, with the second cylindrical portion 21*c* and rectification portion 81 provided so as to extend downstream from the packing 51. Thus, in the present embodiment, the first cylindrical portion 11, the second cylindrical portion 21*c*, and the rectification portion 81 form the main body portion. An attaching threaded portion 113 is provided on the upper end side, in FIG. 16, of the first cylindrical portion 11 (a terminal side in a negative direction in the y axis direction). The attaching threaded portion 113 is an internal thread allowing the spout cap BDc to be attached to a spout of a spout portion B2. The packing 51 is annularly provided under the attaching threaded portion 113 (in a positive direction in the y axis direction) along an inner wall of the first cylindrical portion 11. The packing 51 is a tight contact member for preventing possible water leakage when the spout cap BDc is attached to the spout of the spout portion B2.

When the spout cap BDc is attached to the spout of the spout portion B2 by threadedly fitting the attaching threaded portion 113 of the first cylindrical portion 11 onto an external thread of the spout of the spout portion B2, water Wa supplied by a water faucet device FC is fed from an inflow port 111. The water Wa flows from the inflow port 111 into the first cylindrical portion 11 serving as the main body portion. The water Wa then passes through the internal channel in the first cylindrical portion 11 (the channel extending through the second cylindrical portion 21*c*, the pressure reducing portion 31*c*, the upper reduced diameter portion 41*c*, the lower reduced diameter portion 74, and the rectification portion 81; the internal channel will be described below in detail) to become water Wb, that is, air bubble entrained water or rectified water (water entrained with substantially no air bubbles). The water Wb is then discharged from a discharge port 112 to the exterior (bowl portion).

The upper reduced diameter portion 41*c* is arranged downstream of the packing 51 (the upper reduced diameter portion 41*c* is arranged closer to the discharge port 112 in the positive direction in the y axis direction). The upper reduced diameter portion 41*c* includes an annular flange portion 411*c* forming an outer circumference like a flange of a cap and an annular protruding portion 412*c* surrounded by the flange portion 411*c* and formed in an area of the upper reduced diameter portion 41*c* including the center thereof. The flange portion 411*c* is fixed to the pressure reducing portion 31*c*.

The annular protruding portion 412*c* is formed so as to project upstream from the flange portion 411*c* (the annular protruding portion 412*c* is formed so as to protrude toward the inflow port 111 in the negative direction in the y axis direction). An inflow hole 413*c* is formed in an area of the annular protruding portion 412*c* including the center thereof. Inflow water from the inflow port 111 impinges on the upper reduced diameter portion 41*c*, thus allowing a pressure of the water to be attenuated. The resultant inflow water is then allowed to flow out downstream from the inflow hole 413*c*. The water flowing out downstream from the inflow hole 413*c* flows into a water storage portion 414*c* formed between the upper reduced diameter portion 41*c* and the pressure reducing portion 31*c*.

The pressure reducing portion 31*c* is arranged downstream of the upper reduced diameter portion 41*c*. The pressure reducing portion 31*c* includes a pressure reducing plate 311*c* (pressure receiving plate), an upper holding portion 318*c*, and a lower holding portion 317*c*. The pressure reducing plate 311*c* is a disk-shaped member and is formed of a flexible material such as resin or rubber. The upper holding portion 318*c* and the lower holding portion 317*c* are members for fixing the pressure reducing plate 311*c* and the flange portion 411*c* to the second cylindrical portion 21*c* such that the pressure reducing plate 311*c* and the flange portion 411*c* are sandwiched between the upper holding portion 318*c* and the lower holding portion 317*c*.

A plurality of injection holes 314*c* (orifice portion) are annularly formed in the pressure reducing plate 311*c*. The plurality of injection holes 314*c* are formed at positions corresponding to the water storage portion 414*c*. Hence, the plurality of injection holes 314*c* are formed so as not to be blocked by the flange portion 411*c* of the upper reduced diameter portion 41*c*.

The second cylindrical portion 21*c* is provided outside the upper reduced diameter portion 41*c* and the pressure reducing portion 31*c* and downstream of the first cylindrical portion 11.

Air holes 211*c* configured to introduce air into the internal channel are formed in the second cylindrical portion 21*c*. The air holes 211*c* are formed so as to be scattered all over the circumference of the second cylindrical portion 21*c*.

The lower reduced diameter portion 74 is arranged inside and downstream of the second cylindrical portion 21*c*. The lower reduced diameter portion 74 is a cylindrical member including a reduced diameter taper portion 741 and an increased diameter taper portion 742. The reduced diameter taper portion 741 is provided upstream of the increased diameter taper portion 742 and formed such that the width of the internal channel decreases from the upstream side to the downstream side. The increased diameter taper portion 742 is provided downstream of the reduced diameter taper portion 741 and formed such that the width of the internal channel increases from the upstream side to the downstream side.

An inclined surface 741*a* of the reduced diameter taper portion 741 which is an inner surface thereof is formed at a position corresponding to the plurality of injection holes 314*c* in the pressure reducing portion 31*c*. Thus, a water flow injected from the plurality of injection holes 314*c* in the pressure reducing plate 311*c* impinges on the inclined surface 741*a* and is thus directed inward. The resultant water flow gushes into a gas-liquid interface.

When water fed from the inflow port 111 is injected from the plurality of injection holes 314*c* in the pressure reducing plate 311*c*, the water starts to be filled in the spout cap from the downstream side. Then, a gas-liquid interface is formed at a position corresponding to the lower reduced diameter portion 74. The water flow directed by the inclined surface 741*a* gushes into the gas-liquid surface while being entrained with air. Thus, air bubble entrained water is generated. The pressure reducing plate 311*c* acts to exert a negative pressure between the pressure reducing plate 311*c* and the lower reduced diameter portion 74. Hence, air is drawn in through the air holes 211*c* and gushes into the gas-liquid interface together with the water injected from the plurality of injection holes 314*c*. The water flow gushing into the gas-liquid interface disturbs the gas-liquid interface and thus becomes more likely to be entrained with air bubbles. Thus, the area extending from the pressure reducing plate 311*c* to the lower reduced diameter portion 74 is formed as an air bubble entraining portion 713.

The air bubble entrained water generated by the air bubble entraining portion 713 is rectified by a rectification grid 811 of the rectification portion 81 provided downstream of the air bubble entraining portion 713. The rectified air bubble entrained water is then discharged from the discharge port 112 to the exterior.

In the present example, the pressure reducing plate 311*c* is formed to be flexible. Thus, when the inflow water from the inflow port 111 exceeds a predetermined flow rate, the pressure reducing plate 311*c* is deformed so as to expand downstream. FIG. 17 shows that the pressure reducing plate 311*c* has been deformed. As shown in FIG. 17, when the inflow water from the inflow port 111 exceeds the predetermined flow rate to cause the pressure reducing plate 311*c* to be deformed so as to expand downstream, the water injected from the injection holes 314*c* changes in direction and impinges on a higher part of the inclined surface 741*a*. Hence, the water flows on the inclined surface 741*a* over an increased distance. This reduces the flow velocity of the water gushing into the gas-liquid interface.

As described above, when the inflow water from the inflow port 111 exceeds the predetermined flow rate, an increase in the flow velocity of the water gushing into the gas-liquid interface is suppressed. This reduces the amount of the air entrained in the water and restrains the deformation of the gas-liquid interface. As a result, the entrainment efficiency can be suppressed. Hence, the entrainment efficiency can be easily suppressed using the simple configuration for adjusting the flow velocity.

The embodiments of the present invention have been described with reference to the specific examples. However, the present invention is not limited to these specific examples. That is, the specific examples appropriately re-designed or changed by those skilled in the art are also embraced in the scope of the present invention as long as the examples exhibit the characteristics of the present invention. For example, the elements of the above-described specific examples and the arrangement, materials, conditions, shapes, and sizes of the elements are not limited to those illustrated above but may be appropriately changed. Furthermore, the elements of the above-described embodiments may be combined together wherever technically possible. Combinations of the elements are embraced in the scope of the present invention as long as the combinations exhibit the characteristics of the present invention.

What is claimed is:

1. A water spouting device comprising:

a main body portion with a discharge port formed therein and from which water is discharged, an inflow port formed therein and into which the water to be discharged from the discharge port flows from a water supply source, and an internal channel formed therein and extending from the inflow port to the discharge port;

an orifice portion configured to inject the inflow water from the inflow port toward a downstream side of the internal channel;

an air bubble entraining portion with an opening portion formed therein and through which air is introduced into the internal channel, the air bubble entraining portion entraining the air introduced from the opening portion into the water injected from the orifice portion to generate air bubble entrained water and supplying the air bubble entrained water to the discharge port;

an entrainment rate adjusting portion having a member in order to change a channel structure of the water spouting device and configured to adjust an entrainment rate of the air bubbles entrained in the air bubble entrained water in the air bubble entraining portion, the entrainment rate adjusting portion increasing the entrainment rate until the inflow water from the inflow port reaches a predetermined flow rate, and suppressing an increase in entrainment rate automatically, without manual operation by a user, when the inflow water from the inflow port exceeds the predetermined flow rate; and a biasing device which provides the suppression of the increase in entrainment rate.

2. The water spouting device according to claim 1, wherein the entrainment rate adjusting portion suppresses the amount of the air introduced into the air bubble entraining portion to restrain an increase in the entrainment rate when the inflow water from the inflow port exceeds the predetermined flow rate.

3. The water spouting device according to claim 2, wherein the entrainment rate adjusting portion increases the entrainment rate until the inflow water from the inflow port reaches the predetermined flow rate and suppresses the flow of the air and thus an increase in entrainment rate so as to hinder the air from being entrained into the air bubble entraining portion when the inflow water from the inflow port exceeds the predetermined flow rate.

4. The water spouting device according to claim 3, wherein the entrainment rate adjusting portion increases a channel resistance in the opening portion to suppress the flow of the air and thus an increase in entrainment rate when the inflow water from the inflow port exceeds the predetermined flow rate.

5. The water spouting device according to claim 4, wherein the entrainment rate adjusting portion reduces an opening area of the opening portion with respect to the internal channel to suppress the flow of the air and thus an increase in entrainment rate.

6. The water spouting device according to claim 5, further comprising an attenuation portion configured to attenuate a variation in pressure of the inflow water from the inflow port and then to allow the resultant inflow water to flow out to a downstream side of the internal channel, wherein the entrainment rate adjusting portion comprises a pressure receiving plate configured to receive, in an area of the pressure receiving plate including a center thereof, water flowing out from the attenuation portion and is configured to advance and retract freely along the internal channel under a force exerted by the water received by the pressure receiving plate, and when the amount of the water received by the pressure receiving plate exceeds a threshold water amount, the entrainment rate adjusting portion moves so as to reduce the opening area.

7. The water spouting device according to claim 3, wherein the entrainment rate adjusting portion increases an internal pressure in the air bubble entraining portion to reduce a difference in pressure between the air on an upstream side of the opening portion and the air in the air bubble entraining portion to suppress an increase in entrainment rate.

8. The water spouting device according to claim 7, further comprising a rectification portion provided between the air bubble entraining portion and the discharge port to converge and rectify air bubble entrained water generated by the air bubble entraining portion, wherein the entrainment rate adjusting portion increases a channel resistance in the rectification portion and thus an internal pressure in the air bubble entraining portion to suppress an increase in entrainment rate.

9. The water spouting device according to claim 8, further comprising an attenuation portion configured to attenuate a variation in pressure of the inflow water from the inflow port and then to allow the resultant inflow water from the inflow port to flow out to the downstream side of the internal channel, wherein the entrainment rate adjusting portion comprises a pressure receiving plate configured to receive, in an area of the pressure receiving plate including a center thereof, water flowing out from the attenuation portion and is configured to advance and retract freely along the internal channel under a force exerted by the water received by the pressure receiving plate, and when the amount of the water received by the pressure receiving plate exceeds a threshold water amount, the entrainment rate adjusting portion moves so as to reduce a cross-sectional area of the internal channel in the rectification portion.

10. The water spouting device according to claim 2, wherein the entrainment rate adjusting portion restrains a force to draw air from the opening portion into the air bubble entraining portion to suppress the amount of introduced air when the inflow water from the inflow port exceeds the predetermined flow rate.

11. The water spouting device according to claim 10, further comprising a pressure reducing plate provided so as to block the internal channel and comprising a plurality of holes forming the orifice portion, wherein the air bubble entraining portion is configured to generate a negative pressure by means of water injected from the plurality of holes to draw in air through the opening portion under an effect of the negative pressure, and the entrainment rate adjusting portion suppresses an increase in flow velocity of water injected from the plurality of holes to restrain the force to draw in air through the opening portion when the inflow water from the inflow port exceeds the predetermined flow rate.

12. The water spouting device according to claim 11, wherein the entrainment rate adjusting portion increases the opening area of the plurality of holes to suppress an increase in the flow velocity of the water injected from the plurality of holes when the inflow water from the inflow port exceeds the predetermined flow rate.

13. The water spouting device according to claim 11, wherein the entrainment rate adjusting portion comprises a path other than the plurality of holes formed downstream of the pressure reducing plate in such a manner that the water flows to and through the path, to suppress an increase in the flow velocity of the water injected from the plurality of holes when the inflow water from the inflow port exceeds the predetermined flow rate.

14. The water spouting device according to claim 1, wherein the entrainment rate adjusting portion suppresses efficiency at which the air bubble entraining portion entrains air bubbles into the water to restrain an increase in entrainment rate when the inflow water from the inflow port exceeds the predetermined flow rate.

15. The water spouting device according to claim 14, wherein the water injected from the orifice portion is temporarily stored between the air bubble entraining portion and the discharge port to form a gas-liquid interface, and the water injected from the orifice portion gushes into the gas-liquid interface while being entrained with the air introduced from the opening portion, to form air bubble entrained water, and the entrainment rate adjusting portion restrains an increase in the flow velocity of the water gushing into the gas-liquid interface to suppress the entrainment efficiency when the inflow water from the inflow port exceeds the predetermined flow rate.

16. The water spouting device according to claim 14, wherein the water injected from the orifice portion is temporarily stored between the air bubble entraining portion and the discharge port to form a gas-liquid interface, and the water injected from the orifice portion gushes into the gas-liquid interface while being entrained with the air introduced from the opening portion, to form air bubble entrained water, and the entrainment rate adjusting portion reduces a total extension length over which an outer circumference of the water flow gushing into the gas-liquid interface contacts the gas-liquid interface, to suppress the entrainment efficiency, when the inflow water from the inflow port exceeds the predetermined flow rate.

17. A water spouting device comprising:

a main body portion with a discharge port formed therein and from which water is discharged, an inflow port formed therein and into which the water to be discharged from the discharge port flows from a water supply source, and an internal channel formed therein and extending from the inflow port to the discharge port;

an orifice portion configured to inject the inflow water from the inflow port toward a downstream side of the internal channel;

an air bubble entraining portion with an opening portion formed therein and through which air is introduced into the internal channel, the air bubble entraining portion entraining the air introduced from the opening portion into the water injected from the orifice portion to generate air bubble entrained water and supplying the air bubble entrained water to the discharge port;

an entrainment rate adjusting portion having a member in order to change a channel structure of the water spouting device and configured to adjust an entrainment rate of the air bubbles entrained in the air bubble entrained water in the air bubble entraining portion, the entrainment rate adjusting portion increasing the entrainment rate until the inflow water from the inflow port reaches a predetermined flow rate, and suppressing an increase in entrainment rate automatically, without manual operation by a user, when the inflow water from the inflow port exceeds the predetermined flow rate; and a spring which provides the suppression of the increase in entrainment rate.

18. A water spouting device comprising:

a main body portion with a discharge port formed therein and from which water is discharged, an inflow port formed therein and into which the water to be discharged from the discharge port flows from a water supply source, and an internal channel formed therein and extending from the inflow port to the discharge port;

an orifice portion configured to inject the inflow water from the inflow port toward a downstream side of the internal channel;

an air bubble entraining portion with an opening portion formed therein and through which air is introduced into the internal channel, the air bubble entraining portion entraining the air introduced from the opening portion into the water injected from the orifice portion to generate air bubble entrained water and supplying the air bubble entrained water to the discharge port;

an entrainment rate adjusting portion having a member in order to change a channel structure of the water spouting device and configured to adjust an entrainment rate of the air bubbles entrained in the air bubble entrained water in the air bubble entraining portion, the entrainment rate adjusting portion increasing the entrainment rate until the inflow water from the inflow port reaches a predetermined flow rate, and suppressing an increase in entrainment rate automatically, without manual operation by a user, when the inflow water from the inflow port exceeds the predetermined flow rate; and a deformable member which provides the suppression of the increase in entrainment rate.

* * * * *